US010974120B2

(12) United States Patent
Christopherson

(10) Patent No.: US 10,974,120 B2
(45) Date of Patent: Apr. 13, 2021

(54) ALIGNMENT AID SYSTEM

(71) Applicant: Kenneth Walter Christopherson, Prescott, AZ (US)

(72) Inventor: Kenneth Walter Christopherson, Prescott, AZ (US)

( * ) Notice: Subject to any disclaimer, the term of this patent is extended or adjusted under 35 U.S.C. 154(b) by 27 days.

(21) Appl. No.: 16/601,527

(22) Filed: Oct. 14, 2019

(65) Prior Publication Data

US 2020/0061436 A1 Feb. 27, 2020

Related U.S. Application Data

(60) Provisional application No. 62/811,718, filed on Feb. 28, 2019.

(51) Int. Cl.
*A63B 69/36* (2006.01)

(52) U.S. Cl.
CPC ..... *A63B 69/3667* (2013.01); *A63B 69/3641* (2013.01)

(58) Field of Classification Search
CPC ..... A63B 69/3667; A63B 69/3641
See application file for complete search history.

(56) References Cited

U.S. PATENT DOCUMENTS 1,661,096 A * 2/1928 Rowe ..... G01C 21/00 33/456
3,141,675 A * 7/1964 Street ..... A63B 69/3667 473/218
3,384,377 A * 5/1968 Stipp ..... A63B 69/3667 473/218
3,610,632 A 10/1971 Caldwell
5,482,284 A 1/1996 Vandever
5,588,653 A * 12/1996 Robinson ..... A63B 69/3667 473/218
7,431,661 B1 7/2008 Cailey
7,607,987 B2 10/2009 Alter
8,328,655 B1 12/2012 Stroble
8,608,584 B1 12/2013 Cobb
8,951,140 B1 2/2015 Kim
9,259,635 B2 2/2016 Downing
9,737,757 B1 8/2017 Kiraly
2005/0051978 A1* 3/2005 Sabol ..... A63C 10/14 280/14.24
2009/0124406 A1 5/2009 Alter
2011/0230274 A1 9/2011 Lafortune et al.
2014/0121033 A1 5/2014 Ronald
2015/0258411 A1 9/2015 Krozner
2016/0096101 A1 4/2016 Holland et al.
2017/0189783 A1* 7/2017 Woodrow ..... A63B 69/3676
2018/0056164 A1 3/2018 Simone

FOREIGN PATENT DOCUMENTS

WO WO2018/020265 A1 1/2018

* cited by examiner

*Primary Examiner* — Jeffrey S Vanderveen
(74) *Attorney, Agent, or Firm* — Daniel Christopherson

(57) ABSTRACT

The subject invention comprises a system, and method of using the system, for providing improved alignment in multiple settings. Appropriate settings include woodworking, machining, and sports, although there are several other practical applications for this technology. The invention employs one or more alignment stations that have a base plate that anchors into a flat surface, guides that fit into the base plate, a top rotating element that fits onto the base plate secures the first set of guides into place, and a positional lock that locks the rotating element into place relative to the base plate.

20 Claims, 24 Drawing Sheets

ALIGNMENT AID SYSTEM

BACKGROUND

The prior art includes systems that either fail to take into account one or more of these variables, or cannot he easily adjusted to modify these different variables. Further, golfers and golf instructors will benefit from a system that allows a coach to more easily judge the degree to which a golfer's alignment differs from the desired alignments. Current alignment aids do not provide adequate instructions and easy compatibility with cameras to maximize the view captured by such cameras or similar sensors. Also, current alignment aids are complicated with multiple parts, multiple locking elements, requiring multi-point and complicated adjustments in order to set multiple alignment guides.

SUMMARY OF THE INVENTION

The subject invention comprises a system, and method of using the system, for providing improved alignment in multiple settings. Appropriate settings include woodworking, machining, and sports, although there are several other practical applications for this technology.

The subject invention also relates to an alignment aid system that allows a coach to have a point of reference for each of these alignment factors relative to the user's actual alignments. The subject invention also provides an improved system for users to calibrate their stance and other positions relative to a coach's vantage point to improve a coach's ability to observe differences between the desired motion and the user's actual motion. This application is particularly useful for coaching systems involving still and video photography or other sensors, as the subject invention allows a user to position a camera or other sensor at an optimal position relative to the user so that optimal observation for coaches can be obtained, and optimal feedback can be provided.

One application relates to golf, as the invention provides an alignment aid for aligning a golfer's body, golf ball, golf club, club path, ball path, ball loft and other relevant factors relative to a given target that will benefit from the use of adjustable guides that can be fixed in place. The invention employs one or more alignment stations that have a base plate that anchors into the ground, guides that fit into the base plate, a top rotating element that fits onto the base plate and secures the first set of guides into place, and a positional lock that locks the rotating element into place relative to the base plate. Additional guides can be placed in the top rotating element, as o provide additional guidelines that are different from the guidelines created by the base plate guides. The above structure can be used in a system that incorporates multiple alignment stations, which may be connected by the above-mentioned guides.

When properly employed, the subject invention is an alignment system that allows a user to align multiple elements at once, and thereby improve the overall alignment. For instance, the above system will improve the direction a ball is struck by a golfer. The above system also allows a golfer to make advanced shots, such as draws and fades through the use of curved guides with the above system.

DETAILED DESCRIPTION OF THE INVENTION

Figure 1A:
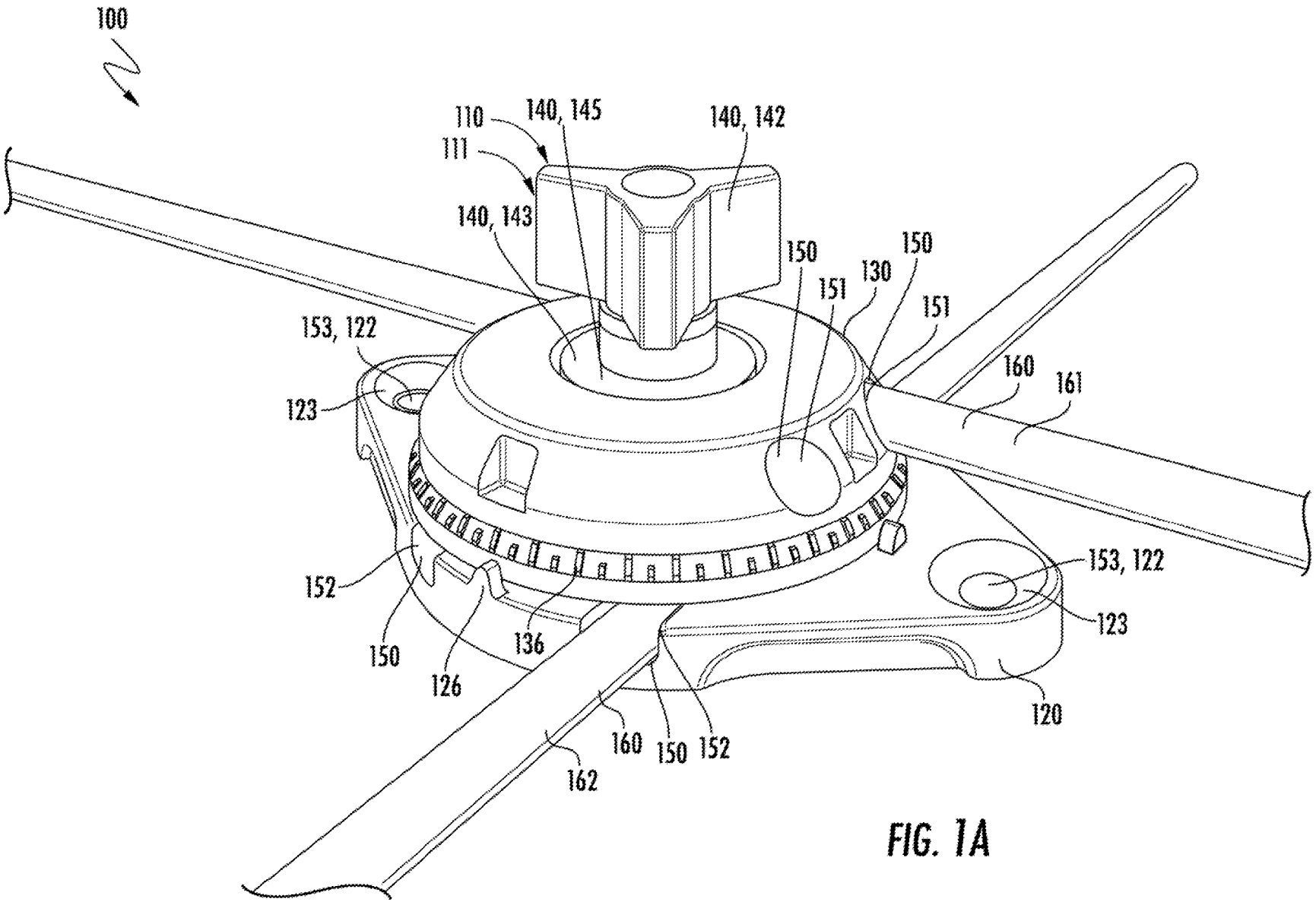
FIG. 1A is a front perspective view of a preferred embodiment of the alignment aid system.

FIG. 1A is a front perspective view of a preferred embodiment of the alignment aid system 100. In this embodiment, alignment aid system 100 comprises one alignment station 110 and two alignment guides 160. Alignment station 110 consists of station base 120, station top 130, and station joiner 140. Station top 130 further comprises top joiner port 131, degree markings 136, and two top ports 151. Station base 120 further comprises two anchor ports 122, two anchor port shoulders 123, two perpendicular ports 153, two base ports 152, and angular indexes 126. Station joiner 140 further comprises washer 143 and nut 142. As shown, first alignment guide 161 passes through one top port 151, and second alignment guide 162 passes through one base port 152.

The length that alignment guides 160 extend from alignment station 110 is set and the angles between first alignment guide 161 and second alignment guide 162 are set by loosening station joiner 140, accomplished by turning nut 142, thereby loosening the tension against top port lock 145, here washer 143. In this loosened state, station top 130 may be rotated concentrically about bolt 141 (shown in FIG. 2) until first alignment guide 161 and second alignment guide 162 are oriented in the desired position. Degree markings 136 can be measured against angular index 126 in order to accurately set and measure the angle between first alignment guide 161 and second alignment guide 162. Also, alignment guides 160 may be adjusted to increase the distance the end of the alignment guide 160 extends from the station base by pulling away from, or shortened to decrease the distance the end of the alignment guide 160 extends from the station base by pushing into, alignment station 110. Different length alignment guides 160 can be used to achieve shorter or longer extensions from both sides of the alignment station 110. Once the angles of first alignment guide 161 and second alignment guide 162 and the desired lengths of alignment guides 160 are set, the angles and lengths can be locked in place by tightening station joiner 140, accomplished by tightening nut 142 to fit firmly against top port lock 145, here washer 143.

Figure 1B:
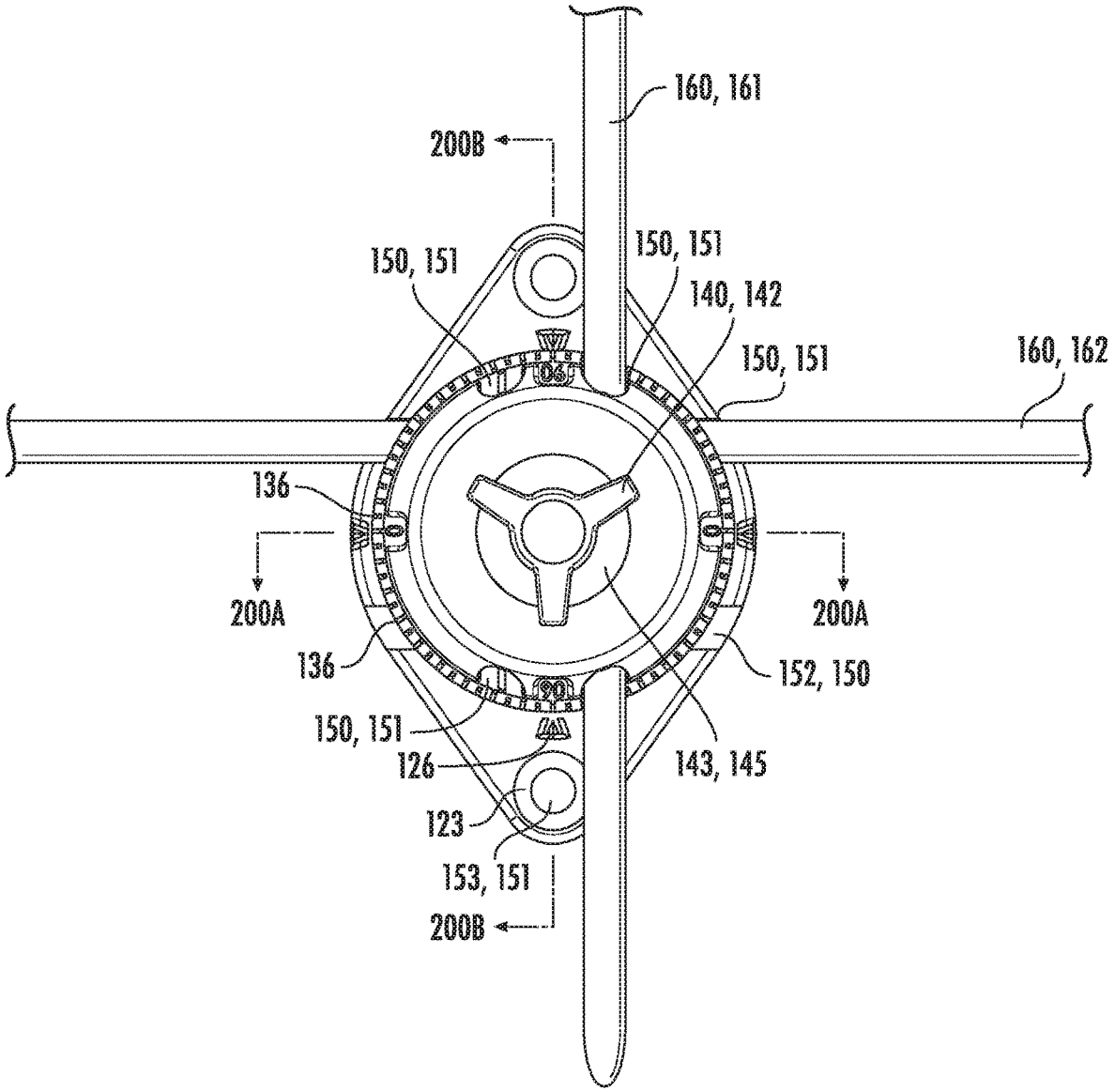
FIG. 1B is a top view of the alignment system shown in FIG. 1A

FIG. 1B is a top view of the alignment aid system shown in FIG. 1A. This view shows the top portion of station joiner 140, comprising bolt 141 and nut 142. Also shown are first alignment guide 161 passing through a top port 151, and second alignment guide 162 passing through a base port 152. Also visible are four angular indexes 126, and degree markings 136. Also shown are two anchor ports 122, two perpedicular ports 153, and two anchor port shoulders 123.

Figure 1C:
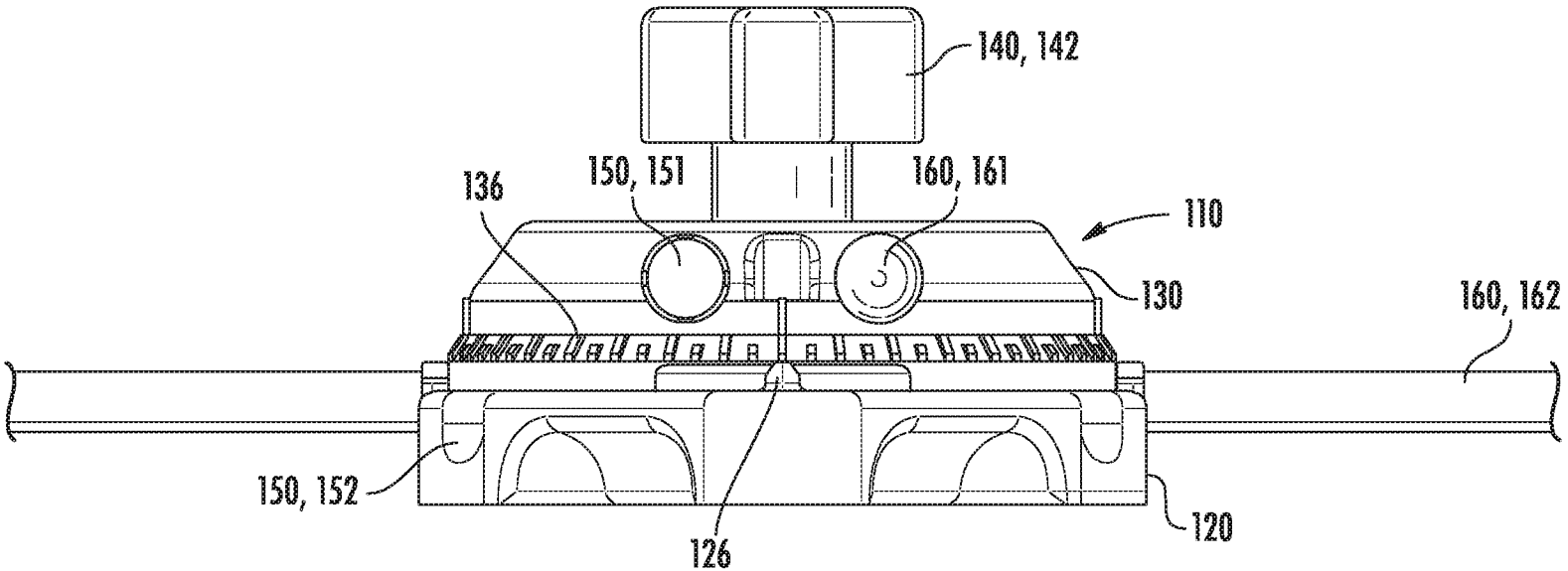
FIG. 1C is a side view of the alignment system shown in FIG. 1A

FIG. 1C is a side view of the alignment aid system 100 shown in FIG. 1A. Shown more fully is nut 142, here shown as a wing nut. Also shown are the front side of alignment station 110, a head on view of first alignment guide 161, and a side view of second alignment guide 162. In this view, first alignment guide 161 and second alignment guide 162 are arranged such that they are perpendicular to one another. In this embodiment, alignment aid system 100 is arranged about a horizontal plane. Under appropriate circumstances, as one with ordinary skill in the art 11 understand, alignment aid system could be arranged about a vertical plane, or any other angular plane.

Figure 1D:
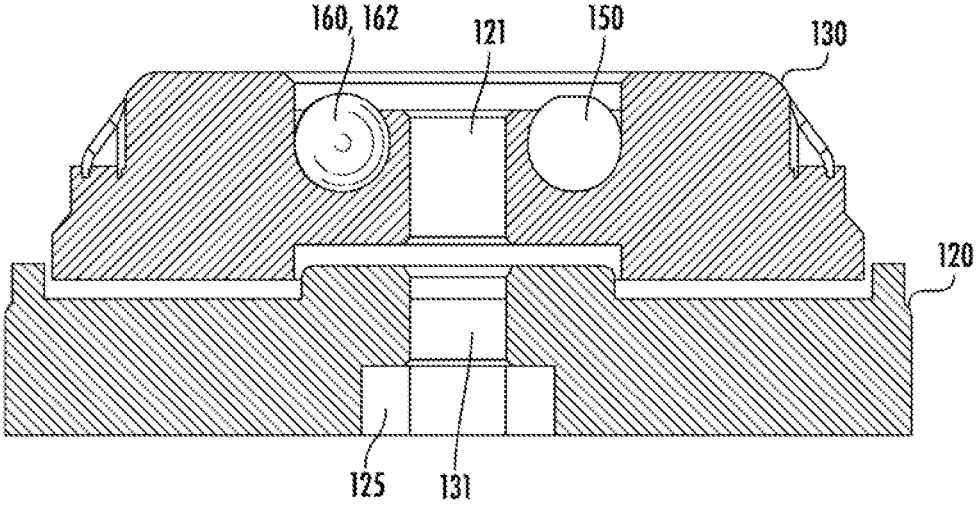
FIG. 1D is a side sectional view taken in the 200A-200A plane of FIG. 1B.

FIG. 1D is a side sectional view taken in the 200A-200A plane of FIG. 1B. As shown, top port 151 passes fully through station top 130. When station top 130 is placed on station base 120, top joiner port 131 and base joiner port 121 align to create a continuous path through which station joiner 140, namely bolt 141 can pass from the top of distinct indentation 125 through to the bottom of lock seat 132.

Figure 1E:
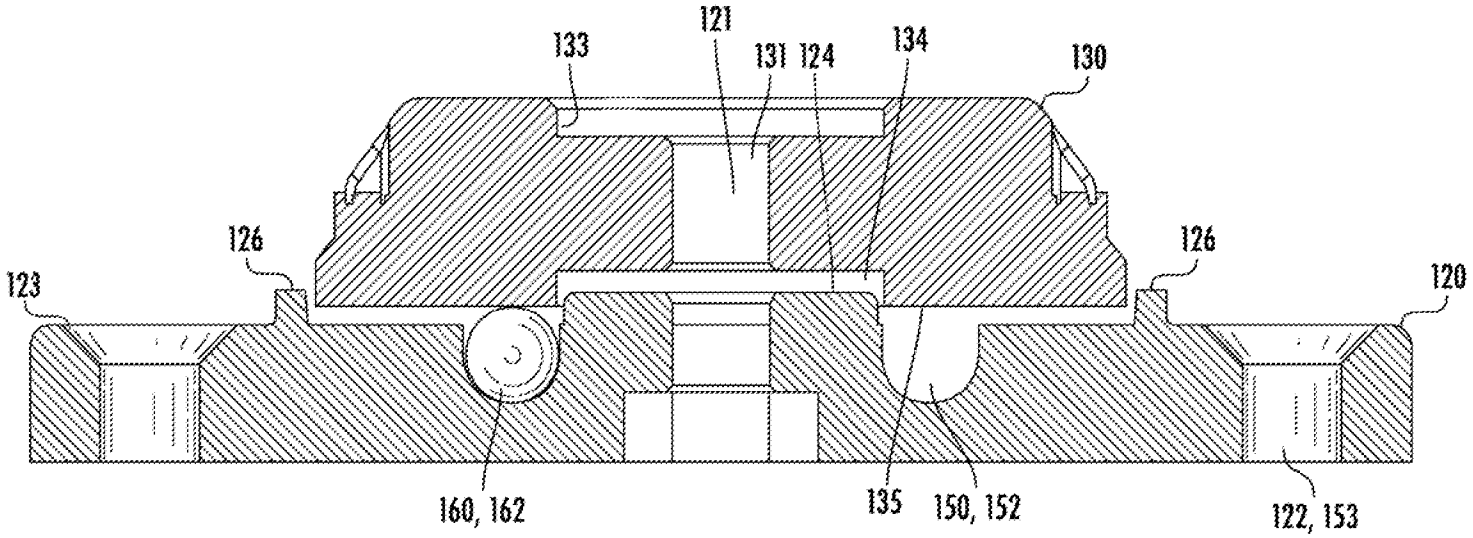
FIG. 1E is a front sectional view taken in the 200B-200B plane of FIG. 1B.

FIG. 1E is a front sectional view taken in the 200B-200B plane of FIG. 1B. As shown, bottom port 152 passes fully through station base 120. When an alignment guide 160, here second alignment guide 162 and/or fourth alignment guide 164, fits inside base port 152 base port lock 135 touches guide 160. When station joiner 140 is tightened, alignment guide 160 is locked in place. Also shown are angular inexes 126. Also shown is the interaction of base port lock 135 with base port 152, as port lock 135 fits near the top end of base port 152. Also shown are the interaction of centering protrusion 124 with protrusion receptacle 134, with protrusion receptacle 134 fitting around centering protrusion 124. When station top 130 is placed on station base 120, top joiner port 131 and base joiner port 121 align to create a continuous path through which station joiner 140, namely bolt 141, can pass from the top of distinct indentation 125 through to the bottom of lock seat 132.

Figure 2A:
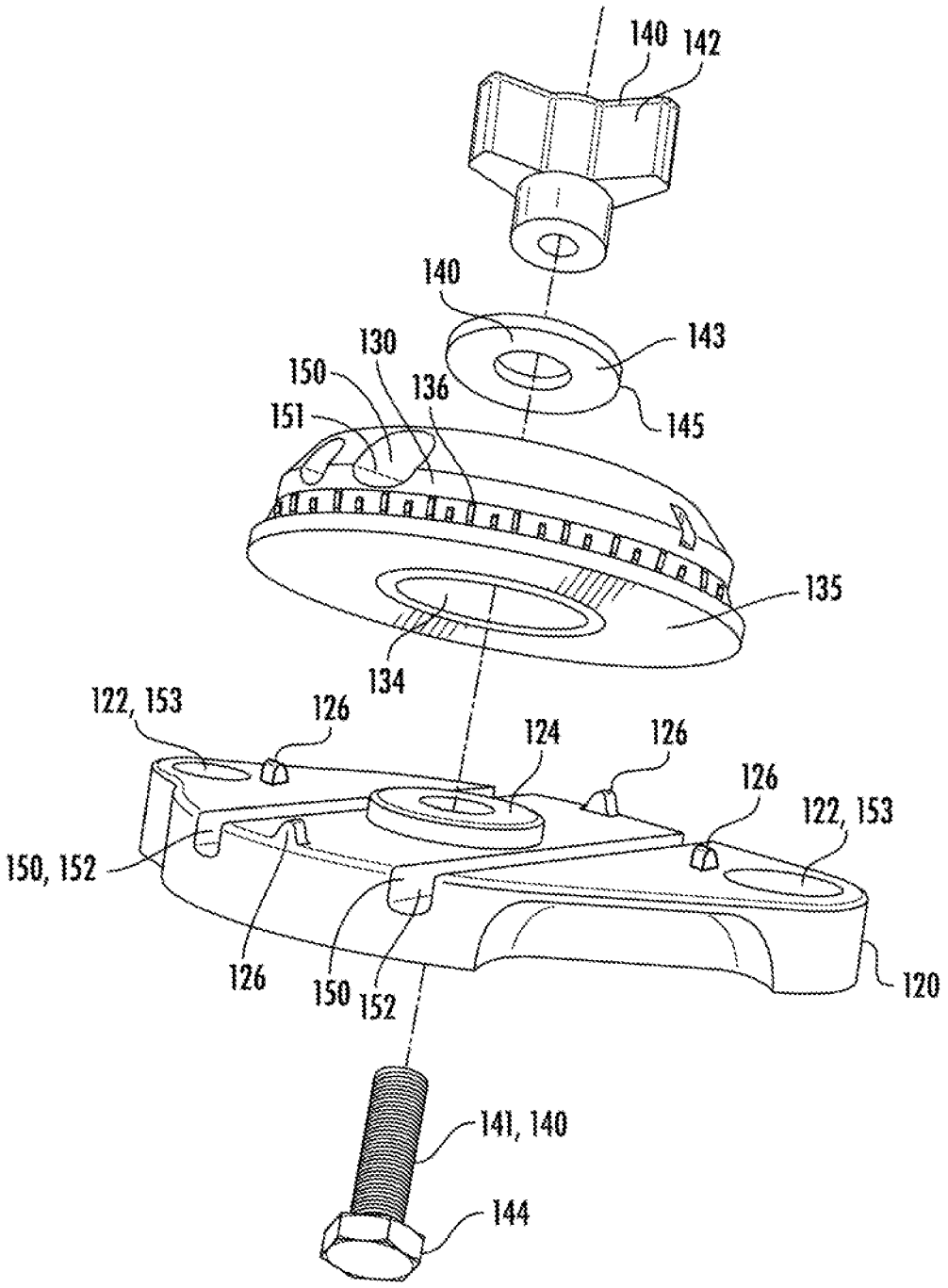
FIG. 2A is an exploded view of the alignment aid system shown in FIG. 1A showing the bottom and side view of the station top, and a top and side view of the station base.

FIG. 2A is an exploded view of the alignment station 110 shown in FIG. 1. In this view, the station top is angled upward, and the station base is angled downward, centering protrusion 124 is visible, located centrally on the top surface of station base 120. Also visible is protrusion receptacle 134 on the bottom surface of station top 130, which comprises a round notch located centrally on the bottom surface of station top 130. Protrusion receptacle 134 is shaped to fit snugly over centering protrusion 124 when station top 130 is placed on top of station base 120. Centering protrusion 124 fits precisely into protrusion receptacle 134, allowing precise rotation of station top 130 against the top surface of station base 120. Top joiner port 131 is located centrally and extends vertically through station base 130. Base joiner port 121 is located centrally and extends vertically through station base 120. Top joiner port 131 fits in line with base joiner port 121 such that when station top 130 is positioned on top of station base 120, centering protrusion 124 fits precisely into protrusion receptacle 134. Bolt 141 is shown, and is shaped to fit freely through base joiner port 121 and top joiner port 131, and extend beyond the top surface of lock seat notch 133. Bolt 141 is shaped to thread into nut 142. Also shown is base port lock 135 on the bottom surface of station top 130.

Figure 2B:
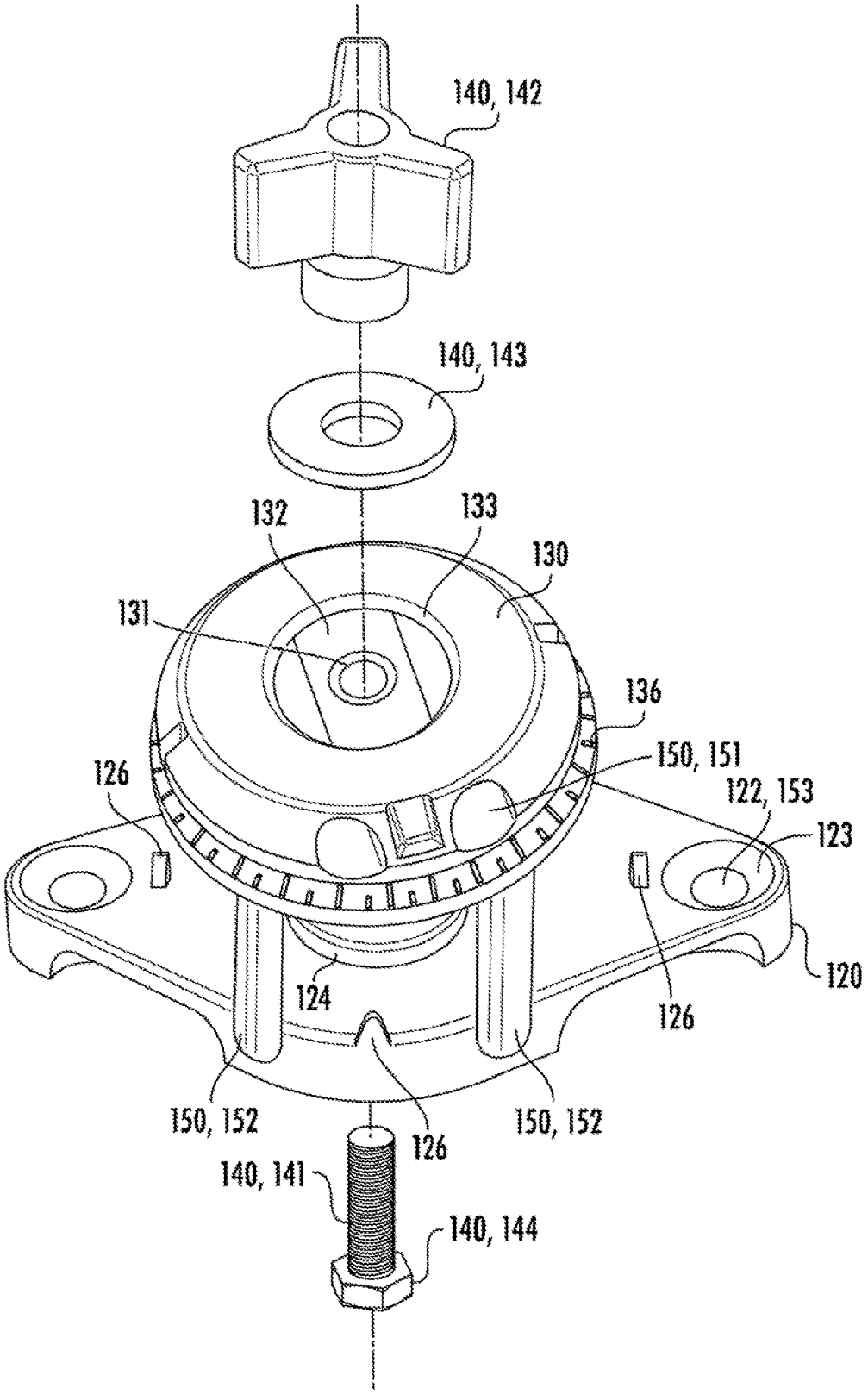
FIG. 2B an alternate exploded view of the alignment system shown in FIG. 2A

FIG. 2B is an exploded view of the alignment station 110 shown in FIG. 1. In this view the top of the station top is angled downward and the station base is also angled downward.

Figure 2C:
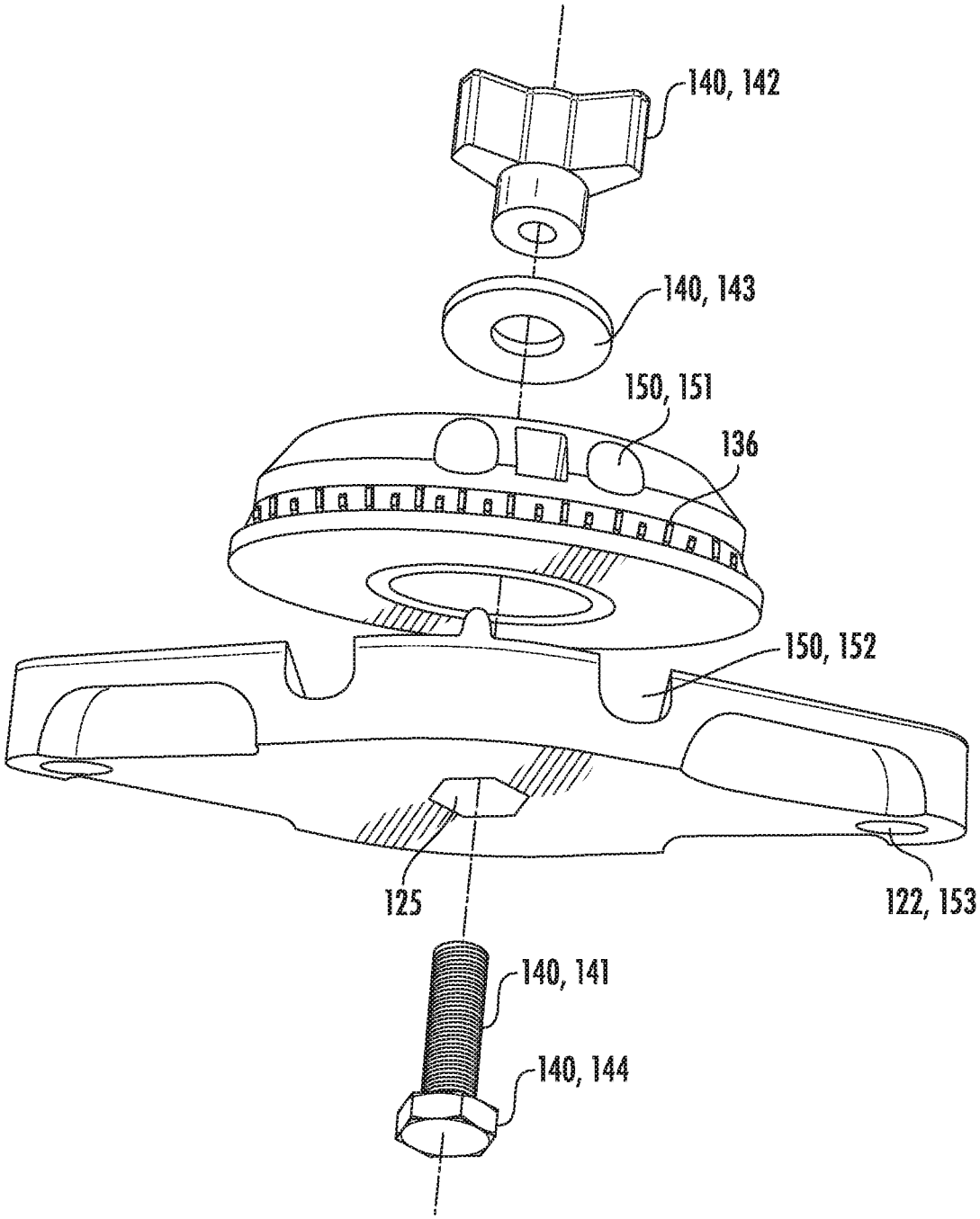
FIG. 2C is an alternate exploded view of the alignment system shown in FIGS. 2A and 2B.

FIG. 2C is an exploded view of the alignment station 110 shown in FIG. 1. In this view the top of the station top is angled upward and the station base is also angled upward.

Figure 3A:
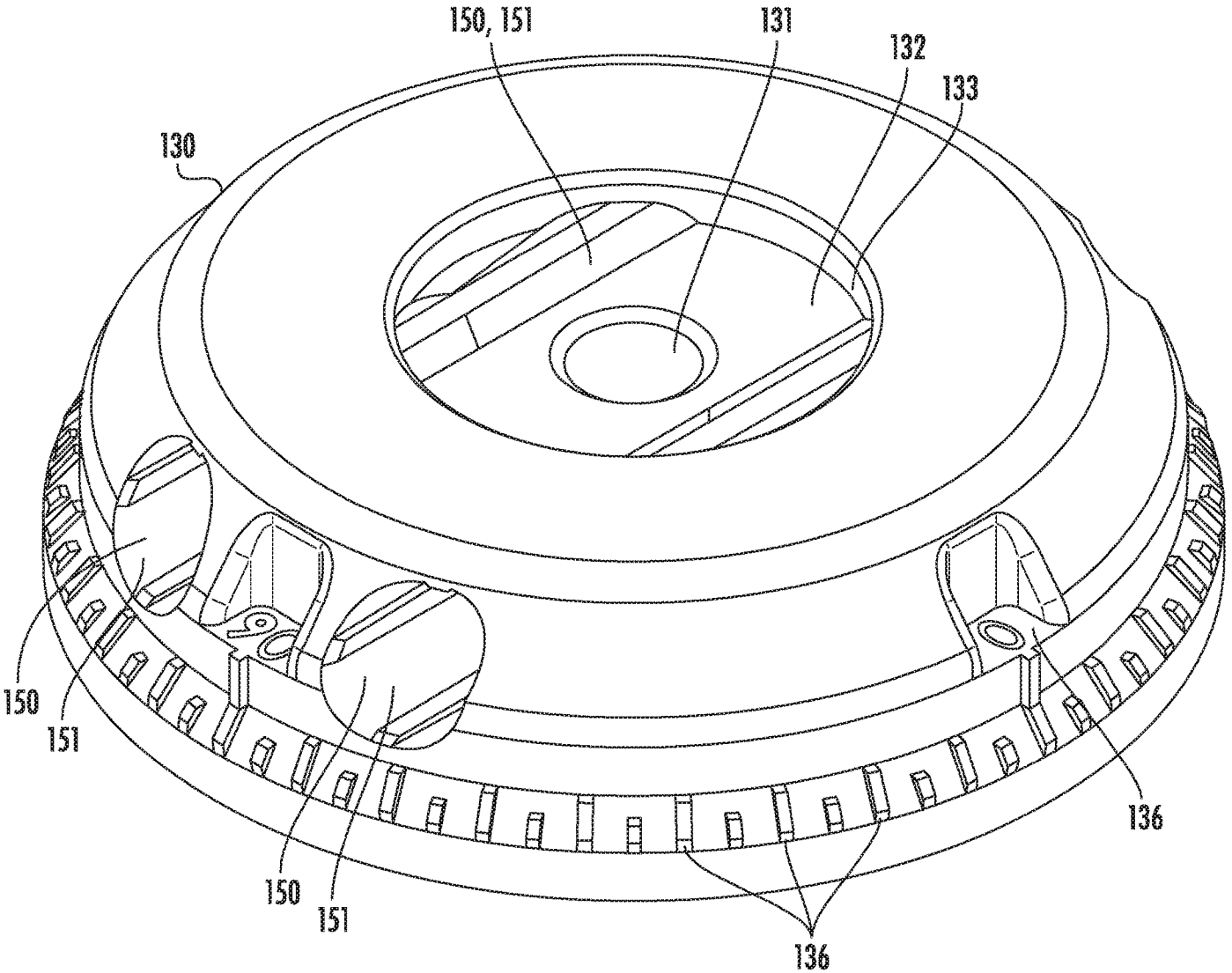
FIG. 3A is a Front perspective view of the station top of the alignment station.

FIG. 3A is a front perspective view of the station top of the alignment station. As shown, station top 130 further comprises lock seat notch 133, lock seat 132, and top joiner port 131. Lock seat notch 133 consists of a notch sized to allow top port lock 145, here washer 143, to fit inside. Lock seat notch 133 partially overlaps the exposed upper areas of top ports 151. Lock seat 132 sits centrally inside lock seat notch 133, and further comprises the top section of top joiner port 131.

Lock seat notch 133 and top port 151 overlap such that, when an alignment guide 160 is placed into a top port 151, the upper surface of first alignment guide 161 and/or third alignment guide 163 is above the plane of the surface of lock seat 132 and exposed. In that position, when a top port lock 145, here washer 143, is placed into lock seat notch 133 and onto lock seat 132, top port lock 145, here washer 143, comes into contact with first alignment guide 161 and/or third alignment guide 163. Further, when bolt 141 is placed through base joiner port 121, top joiner port 131, and washer 143, nut 142 can be tightened at the end of bolt 141, pushing down on washer 143, and locking first alignment guide 161 and/or third alignment guide 163 in place. Also, first alignment guide 161 and/or third alignment guide 163 may be extended or retracted or removed altogether from station base 120 by by loosening nut 142 and washer 143, pulling out or pushing in the appropriate alignment guide 160, and relocking the alignment guides 160 in place by tightening nut 142. Different length alignment guides 160 can be used to achieve shorter or longer extensions from both sides of the alignment station 110.

Also shown are degree markings 136, which here comprise raised lines, set at an angle away from the lower edge of the top surface of station top 130. Under appropriate circumstances, as one with ordinary skill in the art will understand, degree markings 136 could be structured as indentations, etchings, drawings, decals, or the like.

Figure 3B:
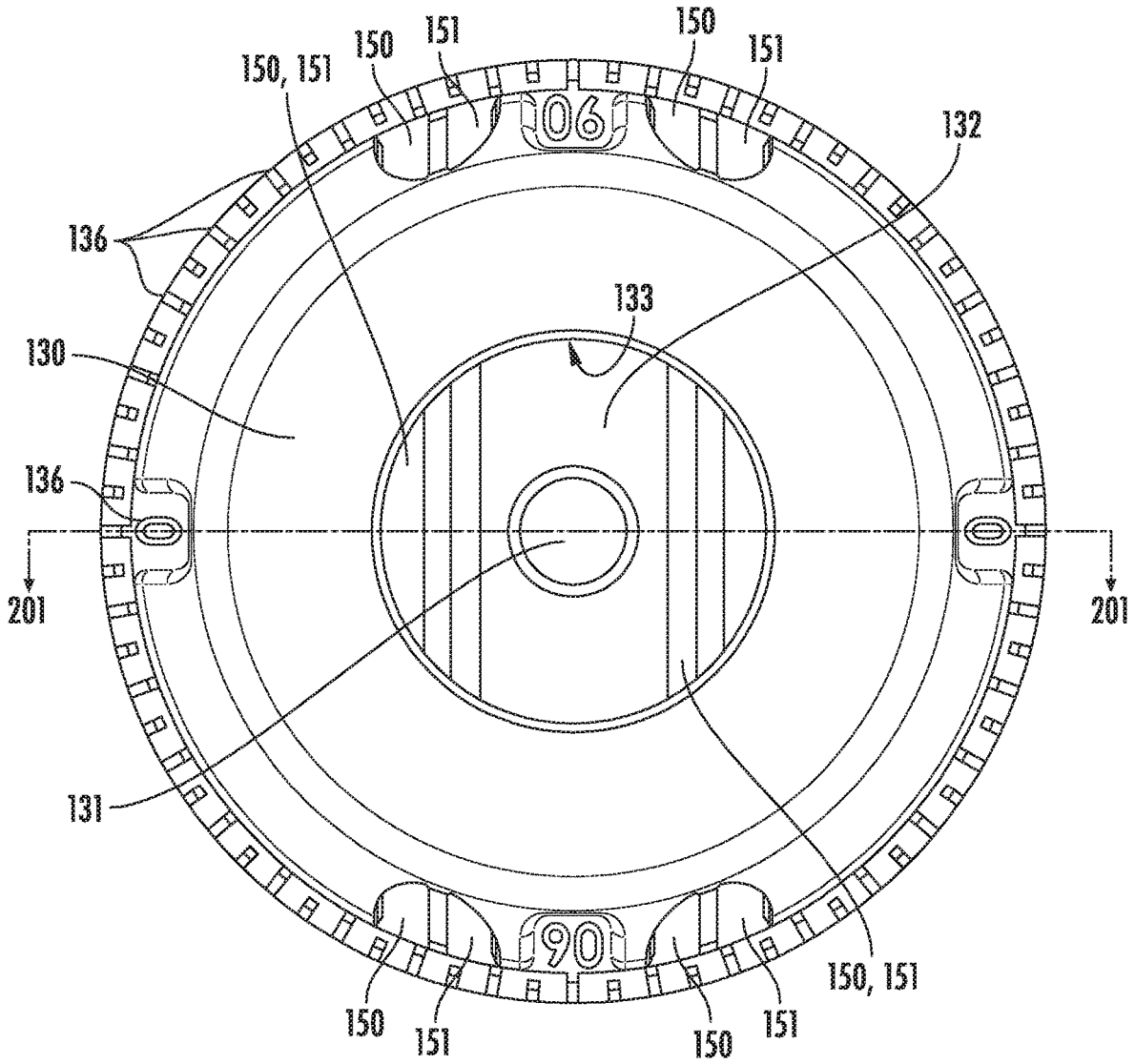
FIG. 3B is a top view of the station top shown in FIG. 3A.

FIG. 3B is a top view of station top 130. More clearly shown are the exposed top portions of the two top ports 151, lock seat notch 133, lock seat 132, and degree markings 136. The exposed two top ports 151 enable the alignment guides 160, here first alignment guide 161 and third alignment guide 163 to be exposed, and compressed by station joiner 143, fixing them in place.

Figure 3C:
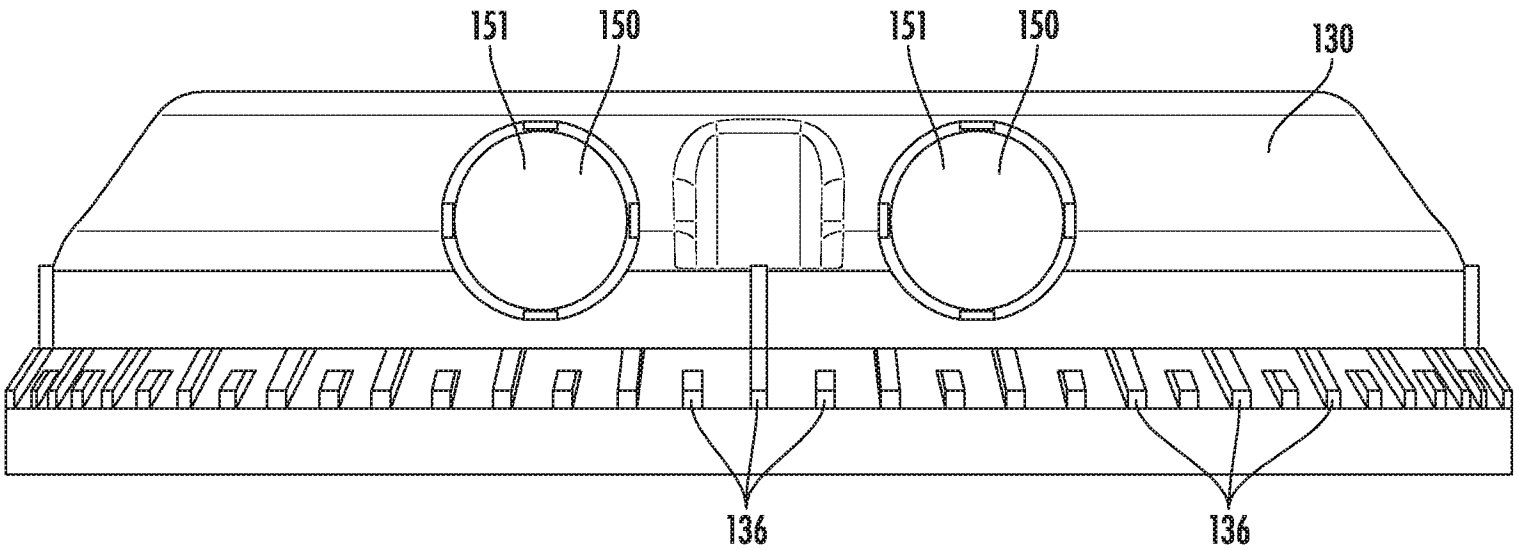
FIG. 3C is a side view of the station top shown in FIGS. 3A and 3B.
Figure 3D:
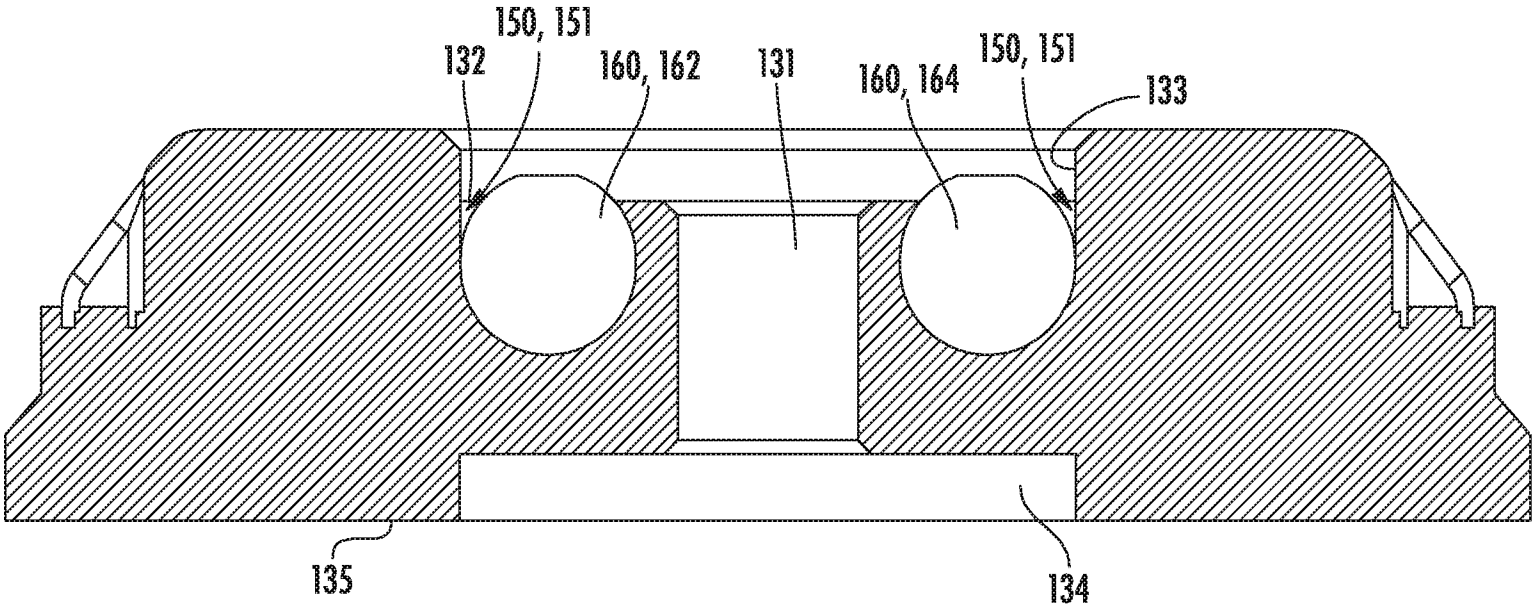
FIG. 3D is a sectional view taken in the 201-201 plane of FIG. 3B.
Figure 3E:
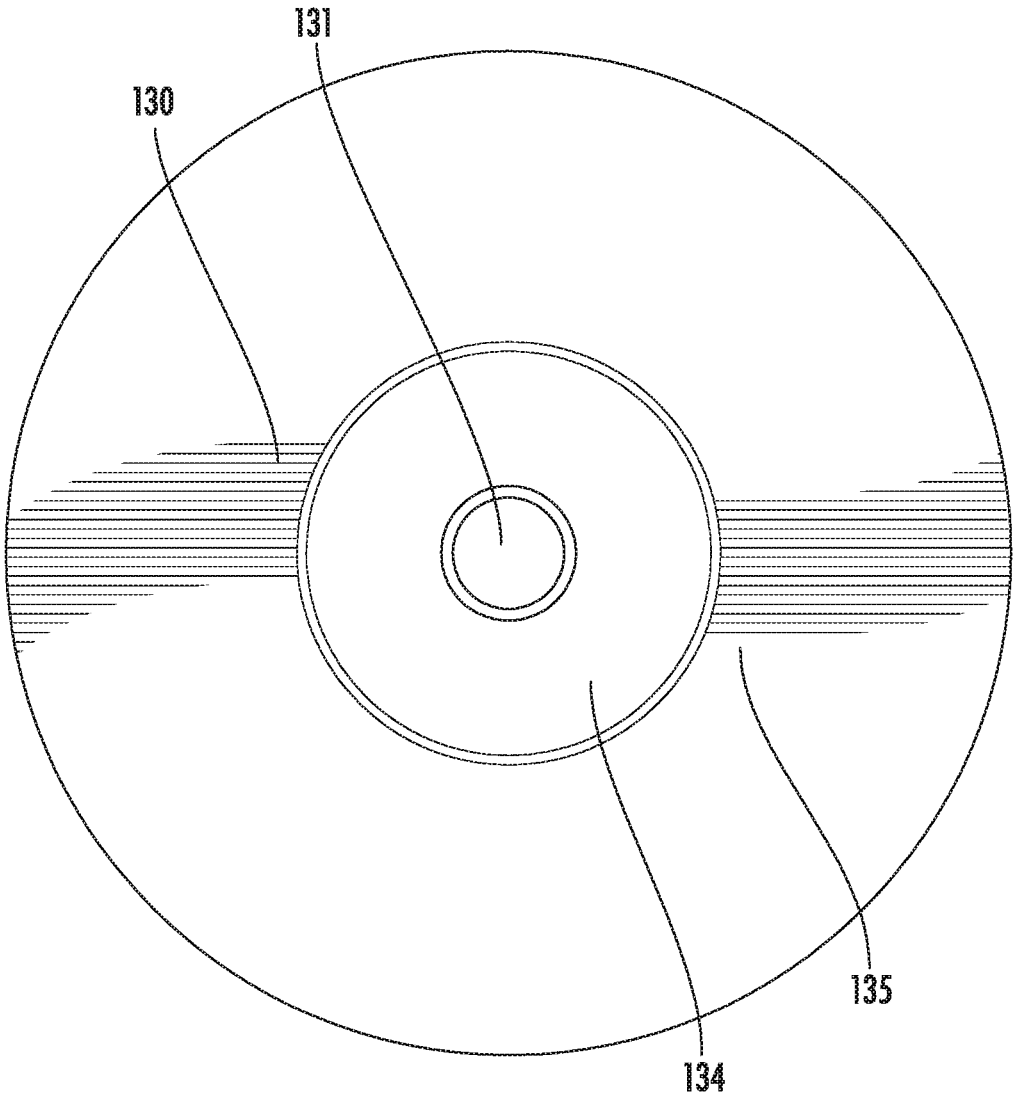
FIG. 3E is a bottom view of the station top shown in FIGS. 3A and 3B.

FIG. 3C is a side plan view of station top 130. FIG. 3D is side plan, sectional view taken in the 201-201 plane of FIG. 3B. As shown is FIG. 3C, top ports 151 extend all of the way horizontally through station top 130.

FIG. 3D is side plan, sectional view taken in the 201-201 plane of FIG. 3B. As shown, protrusion receptacle 134 extends across a central section of the bottom of station top 130. Also, top joiner port 131 extends vertically from the top of protrusion receptacle 134 through to the bottom part of lock seat notch 133. Also, this view shows that base port lock 135 is level with the bottom surface of station top 130, and is used to compress the alignment guides 160, here second alignment guide 162 and fourth alignment guide 164, positioned in base ports 152 within the station base 120, to lock them in position when the station joiner 140 is compressed by bolt 141, washer 143 when the nut 142 is tightened. Also, this view more clearly shows the overlap between top port 151 and lock seat notch 133. Wherein a portion of top port 151 is exposed within lock seat notch 133, and alignment guide 161 and or alignment guide 163 are aligned such that the top surface of alignment guide 161 and alignment guide 163 are above the bottom of lock seat notch 134 and top of lock seat 133.

3E is a view of the bottom of station top 130. As shown, top joiner port 131 extends vertically from the bottom of protrusion receptacle 134 all of the way through station top 130. This view more clearly shows the circular shape of protrusion receptacle 134.

As shown in FIGS. 3A through 3E, station top 130 comprises the following components: top joiner port 131, lock seat 132, lock seat notch 133, protrusion receptacle 134, base port lock 135, degree markings 136, and all top ports 151, all of which are components of the same monolithic station top 130.

Figure 4A:
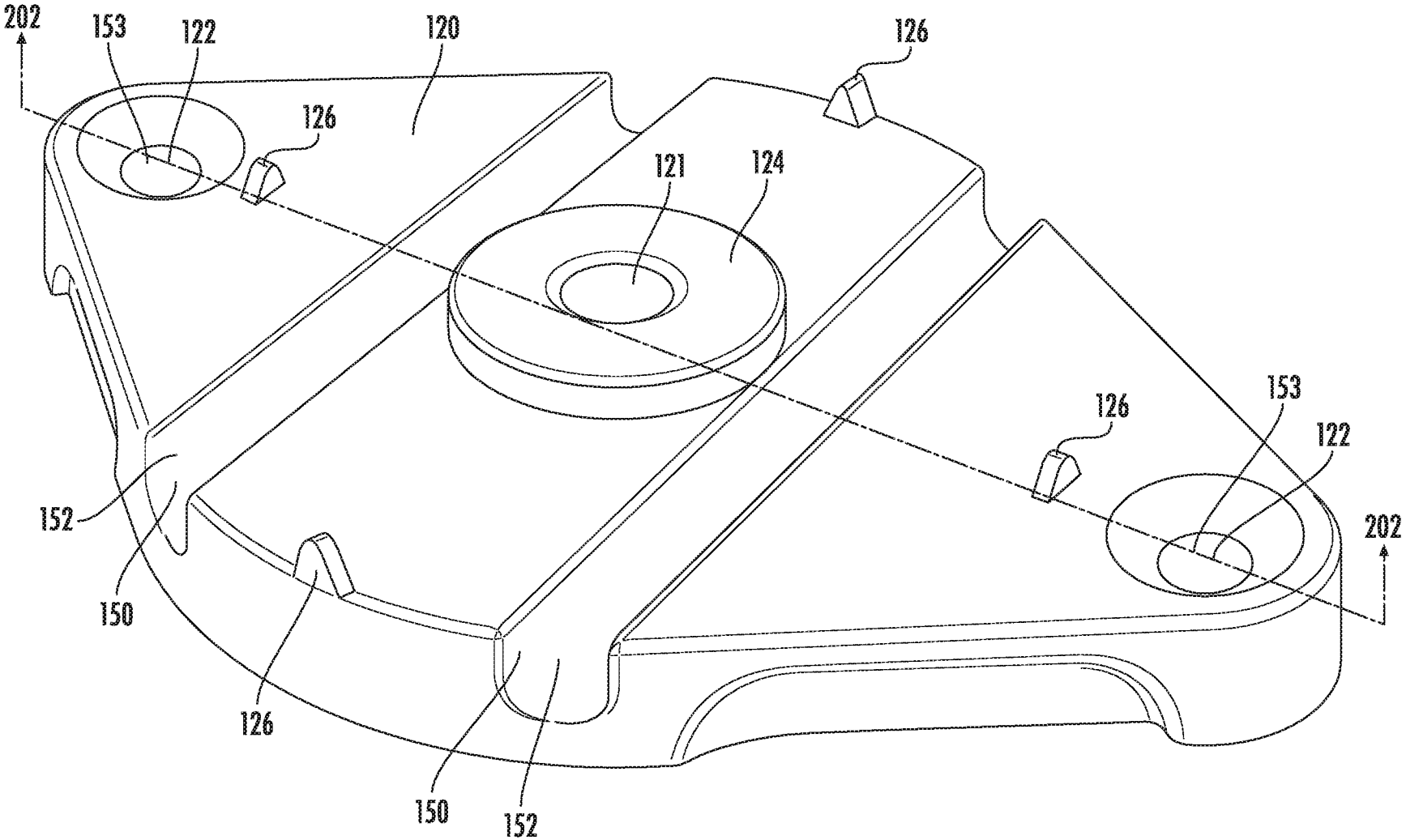
FIG. 4A is a front perspective view of the station base of the alignment station.

FIG. 4A is a front perspective view of the top side of station base 120. As shown, station base 120 comprises two base ports 152, two anchor ports 122, two anchor port shoulders 123, two perpendicular ports 153, centering protrusion 124, four angular indexes 126; and base joiner port 121.

Anchor port 122 comprises circular holes located near the long ends of station base 120. An anchor 173 can be placed through anchor port 122 and into the ground or other otherwise attaching to flat surface. Under appropriate circumstances, as one with ordinary skill in the art will understand, an anchor could be a golf tee, nail, suction cup, hook and loop system, or magnet.

Perpendicular ports 153 comprise circular holes located near the long ends of station base 120. An alignment guide 160 can be used as a perpendicular alignment guide 165, which may be placed through a perpendicular port 153, with one end of the perpendicular alignment guide resting against or pressed into the ground or other flat surface, and the remainder of perpendicular alignment guide extending perpendicularly from alignment station 110.

Centering protrusion 124 comprises an area located centrally on the top of station base 120, raised above the surface of station base 120. Centering protrusion 124 extends into protrusion receptacle 134 in the bottom of station top 130 and fits precisely, enabling station top 130 to rotate centrally about bolt 141.

Base joiner port 121 is located In the center of centering protrusion 124, extending from the top of centering protrusion 124 to the bottom of station base 120, allowing bolt 141 to pass through.

As shown, four angular indexes 126 are located uniformly at 90 degree intervals along the lateral and medial axises of station base 120. When station top 130 is placed on top of station base 120, angular indexes 126 protrude above the top surface of station base 120 and above the bottom lip of station top 130, pointing to a specific setting degree markings 136. Also, when station top 130 is placed on top of station base 120, angular indexes 126 sit just outside the bottom lip of station top 130.

Station base 20 further comprises two base ports 152. As shown, base ports 152 comprise open-top channels structured to house alignment guides 160. The top surface of the station base 120 lies below the top surface of the alignment guides 160 such that when an alignment guide 160 is placed into a base port 152, the upper surface of second alignment guide 162 and/or fourth alignment guide 164 is above the plane of the surface of station base 120. This design enables the station top to compress the exposed top of the alignment guides 160 when station joiner 140 is compressed by tightening the nut 142. Further, when bolt 141 is placed through base joiner port 121, top joiner port 131, and washer 143, nut 142 can be tightened at the end of bolt 141, pushing down on washer 143 and compressing station top 130, pressing base port lock 135 down against the alignment guides 160 placed in base ports 152, here second alignment guide 162 and/or fourth alignment guide 164. Also, second alignment guide 162 and/or fourth alignment guide 164 may be extended or retracted or removed altogether from station base 120 by loosening nut 142 and washer 143, pulling out or pushing in the appropriate alignment guide 160, and relocking the alignment guides 160 in place by tightening nut 142. Different length alignment guides 160 can be used to achieve shorter or longer extensions from both sides of the alignment station 110.

Figure 4B:
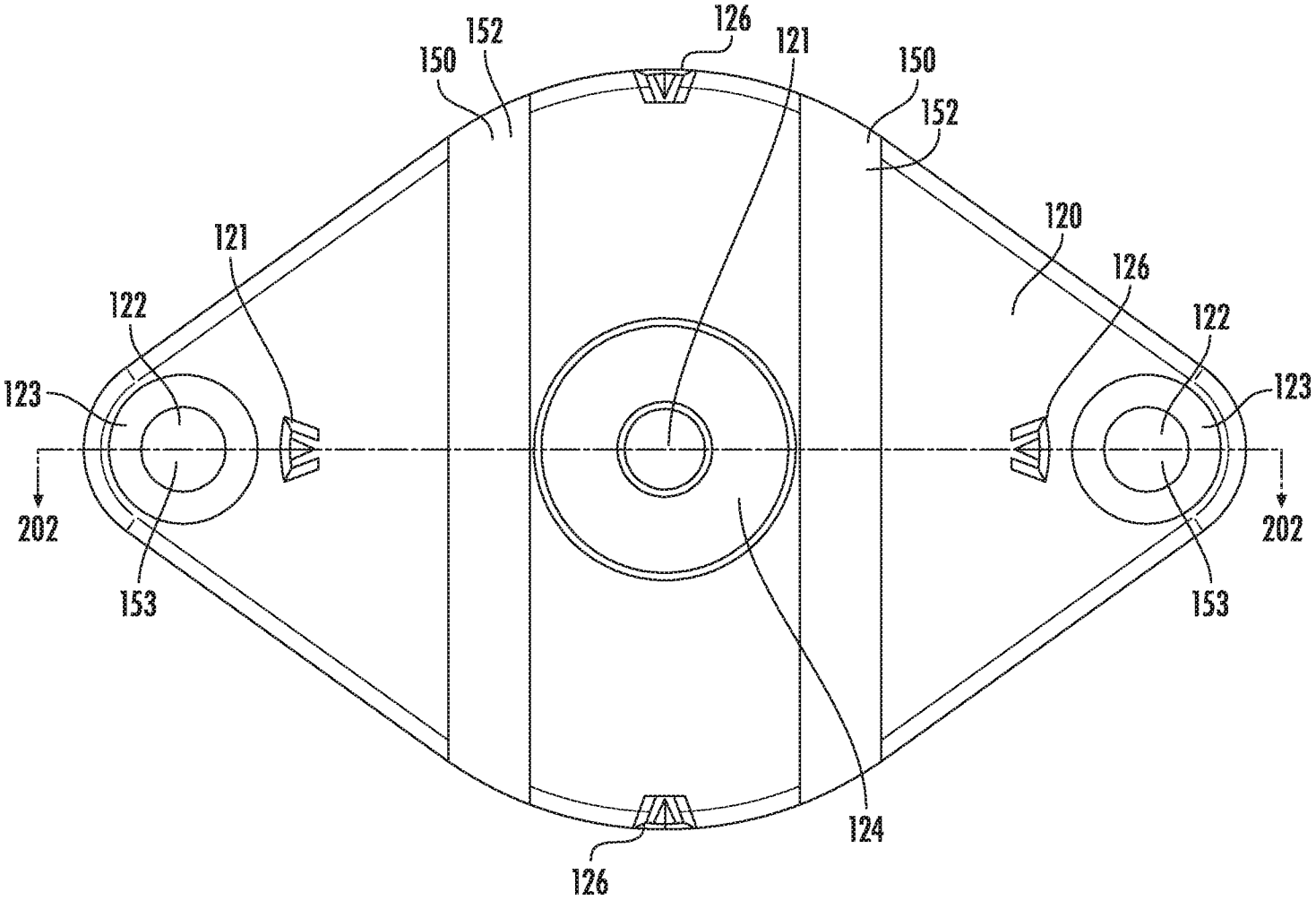
FIG. 4B is a top view of the station base shown in FIG. 4A.

FIG. 4B is a top view of station base 120. More clearly shown are the full length of base ports 152. Also shown are the shapes of anchor ports 122 and perpendicular ports 153, centering protrusion 124, base joiner port 121, and station base 120. Also shown are the precise locations of angular indexes 126. Anchor port shoulder 123 is shown bordering anchor port 122. Anchor port shoulder 123 is sloped to allow a tee to be pushed deep enough to allow the bottom edge of an alignment guide 160 that is placed in the guide port 150 of the station top 130, in guide port 151, to pass over the top of anchor 173 without touching anchor 173.

Figure 4C:
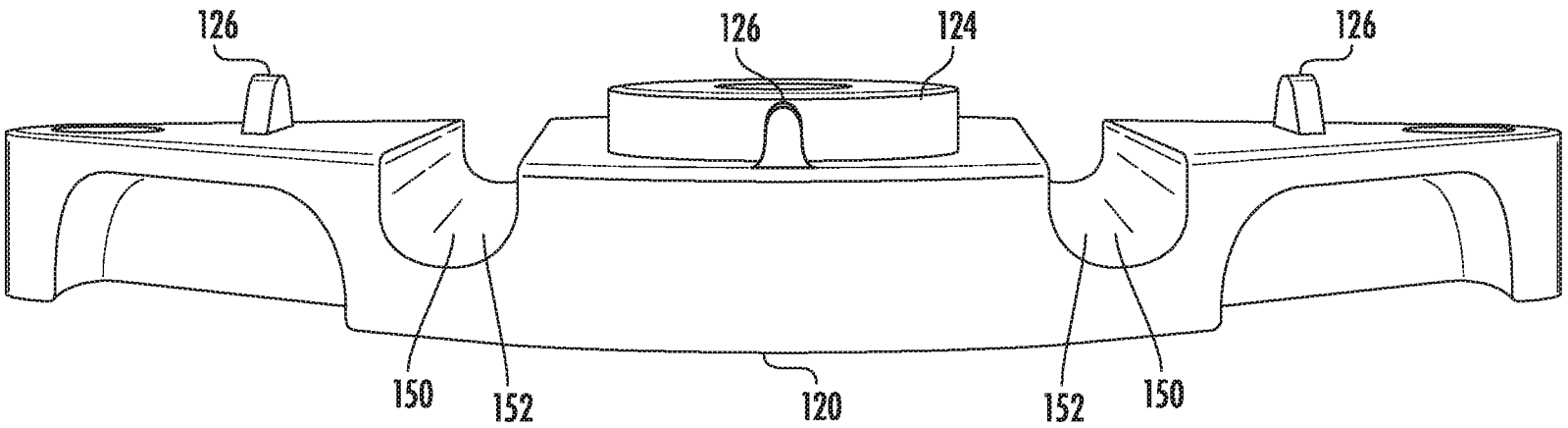
FIG. 4C is a side view of the station base shown in FIGS. 4A and 4B.

FIG. 4C is a side view of station base 120. As shown, alignment guide ports 152 extend all of the way through station base 120.

Figure 4D:
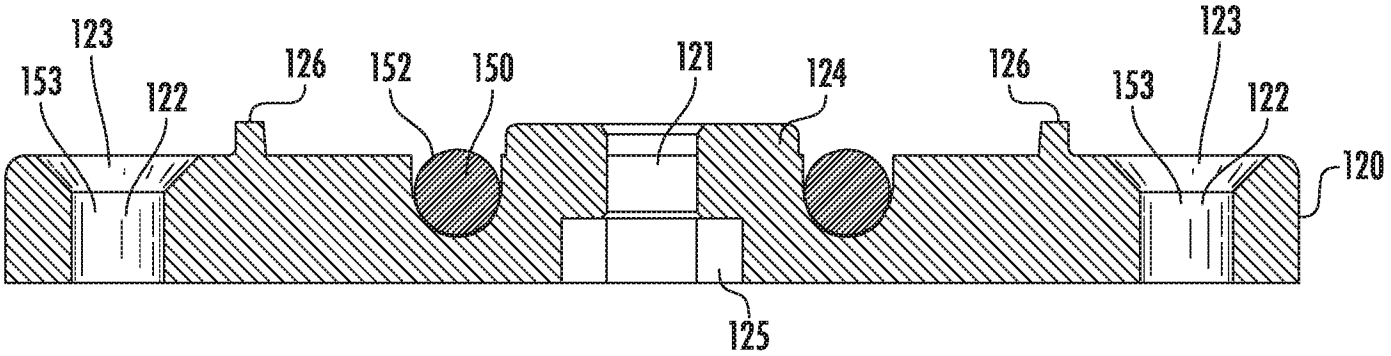
FIG. 4D is side, sectional view taken in the 202-202 plane of FIGS. 4A and 4B.

FIG. 4D is a side sectional view taken in the 202-202 plane of FIG. 4B. As shown, distinct indentation 125 comprises a hollow notch in the bottom of station base 120. Base joiner port 121 extends vertically from the top of distinct indentation 125 vertically through station base 120 through the top of centering protrusion 124. Centering protrusion 124 extends above the top surface of station base 120. Angular indexes 126 extend above the top surface of station base 120. As shown, anchor port 122 extends vertically through the bottom of station base 120 to the bottom of anchor port shoulder 123. Anchor port shoulder 123 comprises a sloped recession from the top surface of station base 120 to the top of anchor port 122. Perpendicular port 153 passes from the top of station base 120, through anchor port shoulder 123, and to the bottom surface of station base 120.

Two base ports 152 are shown. Base ports 152 are structured so that when an alignment guide 160 is housed in a base port 152, the top of the alignment guide 160 extends beyond the top surface of station base 120.

Figure 4E:
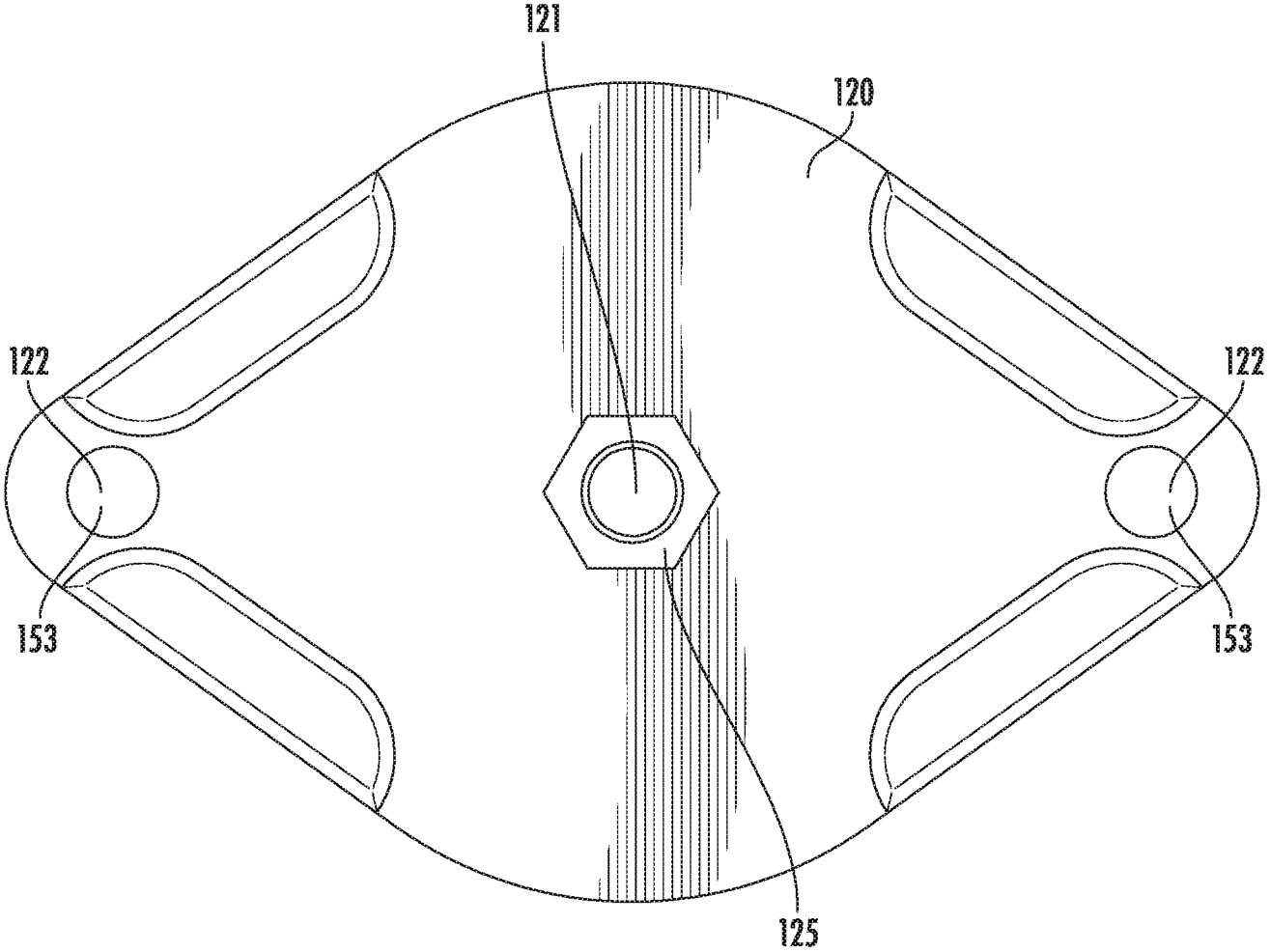
FIG. 4E is a bottom view of the station base shown in FIG. 4A.

FIG. 4E is a bottom view of station base 120. As shown, station base 120 further comprises a distinct indentation 125 on the bottom surface, such that the distinct indentation 125 precisely fits the joiner head 144 within its indentation. This distinct indentation is centered such that when the joiner head 144 is placed within distinct indentation 125, the bolt 141 is centered in the station base 120 station base joiner port 121, which is also centered in the station top 130 top joiner port 131. The joiner head 144 fits into the bottom of the station base 120 into the distinct indentation 125 such that the surface of the joiner head 144 is flush or below the level of the bottom surface of the station base 120. The joiner head 144 is captured within the distinct indentation 125, such that the bolt 141 is held in place, and cannot turn when the nut 142 is tightened or loosened on the bolt 141 threads.

Figure 4F:
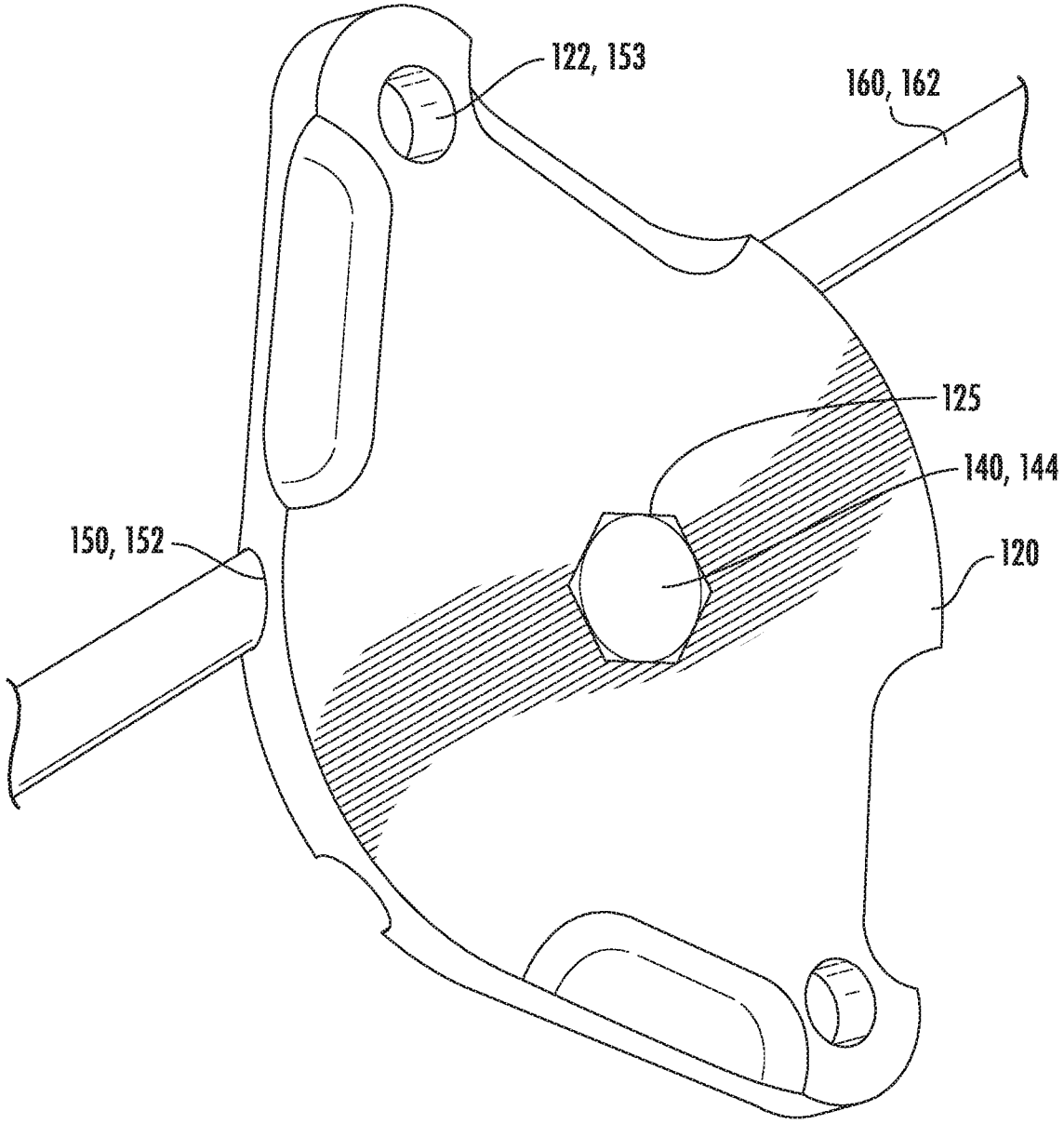
FIG. 4F is a bottom perspective view of the station base shown in FIG. 4A.
Figure 4G:
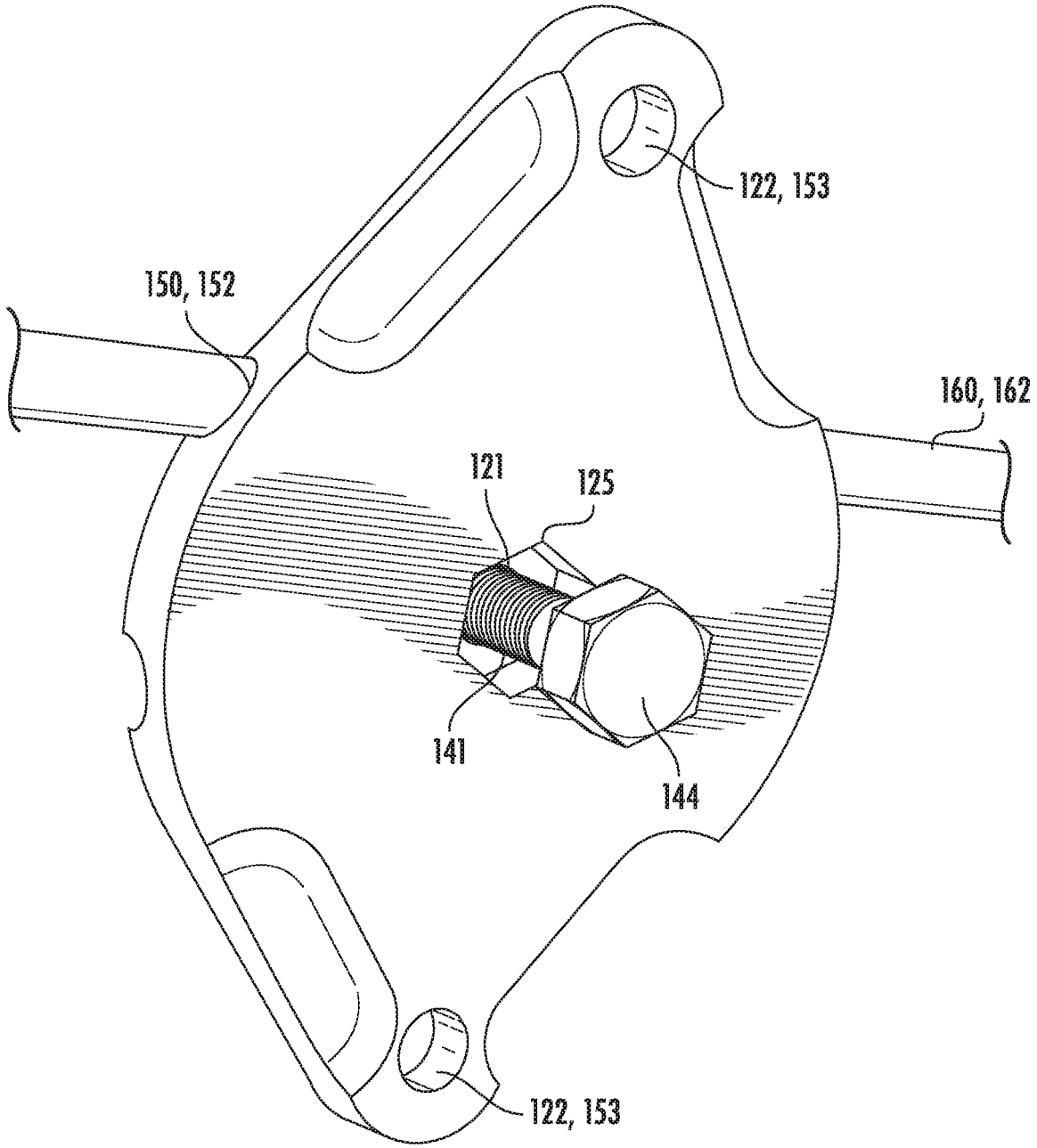
FIG. 4G is a bottom perspective view of the station base shown in FIG. 4A.

FIGS. 4F and 4G are perspective views of the bottom of station base 120. As shown, joiner head 144 has the same form factor as the distinct indentation 125, such that joiner head 144 fits precisely into distinct indentation 125. In this position, the top surface of the joiner head 144 is at or below the bottom surface of station base 120. As shown, bolt 141 is inserted partially into base joiner port 121, but not fully seated within distinct indentation 125. When bolt 141 is fully inserted into base joiner port 121, bolt 141 is locked such that bolt 141 cannot rotate.

As shown in FIGS. 4A through 4G, station base 120 comprises the following components: base joiner port 121, anchor ports 122, anchor ports 122, anchor port shoulders 123, centering protrusion 124, distinct indentation 125, angular indexes 126, and base ports 152, all of which are monolithic components of the same station base 120.

Figure 5A:
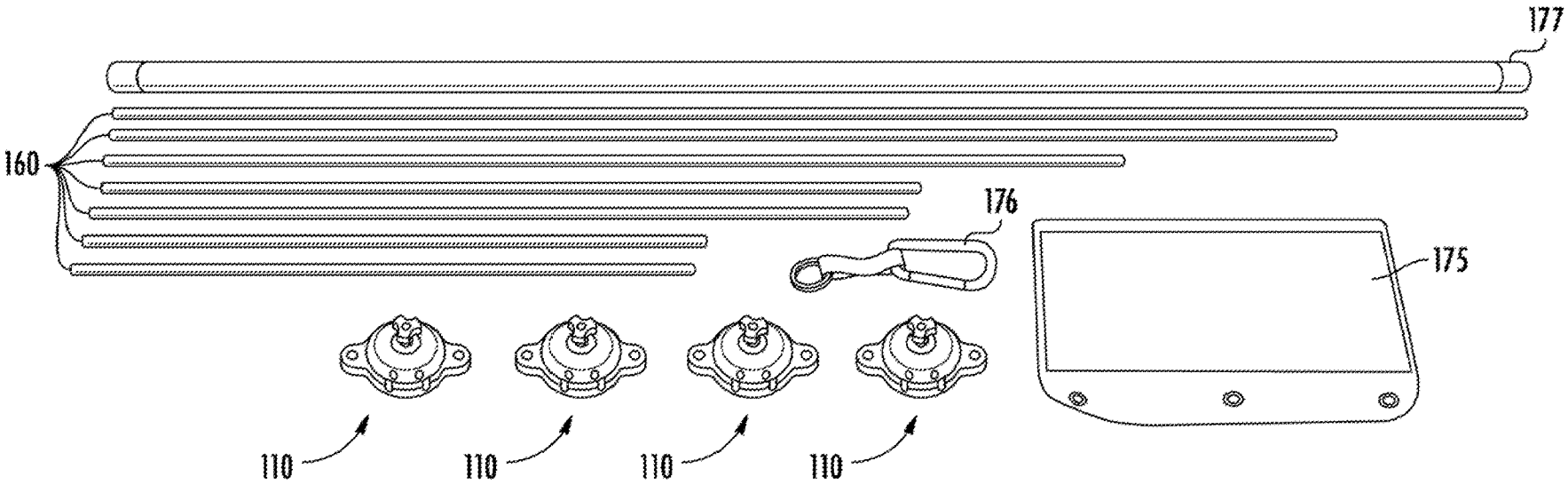
FIG. 5A is an alternate front perspective view of the alignment aid system, with the parts disassembled and laid out.

FIG. 5A is an alternate front perspective view of an alternate embodiment of alignment aid system 100, with the parts disassembled and laid out. In this embodiment, alignment aid system 100 comprises seven alignment guides 160, four alignment stations 110, carrying case 175, carabiner 176, and guide tube 177. Guide tube 177 is structured to simultaneously hold all of seven alignment guides 160. Carrying case 175 is structured to simultaneously hold all four alignment stations 110. Carabiner 176 is structured to fit through a hole in the corner of carrying case 175 and a hole in the top of guide tube 177, securing carrying case 175 to guide tube 177. In this arrangement, alignment aid system 100 can be easily stored upright in a club slot of a golf bag.

Figure 5B:
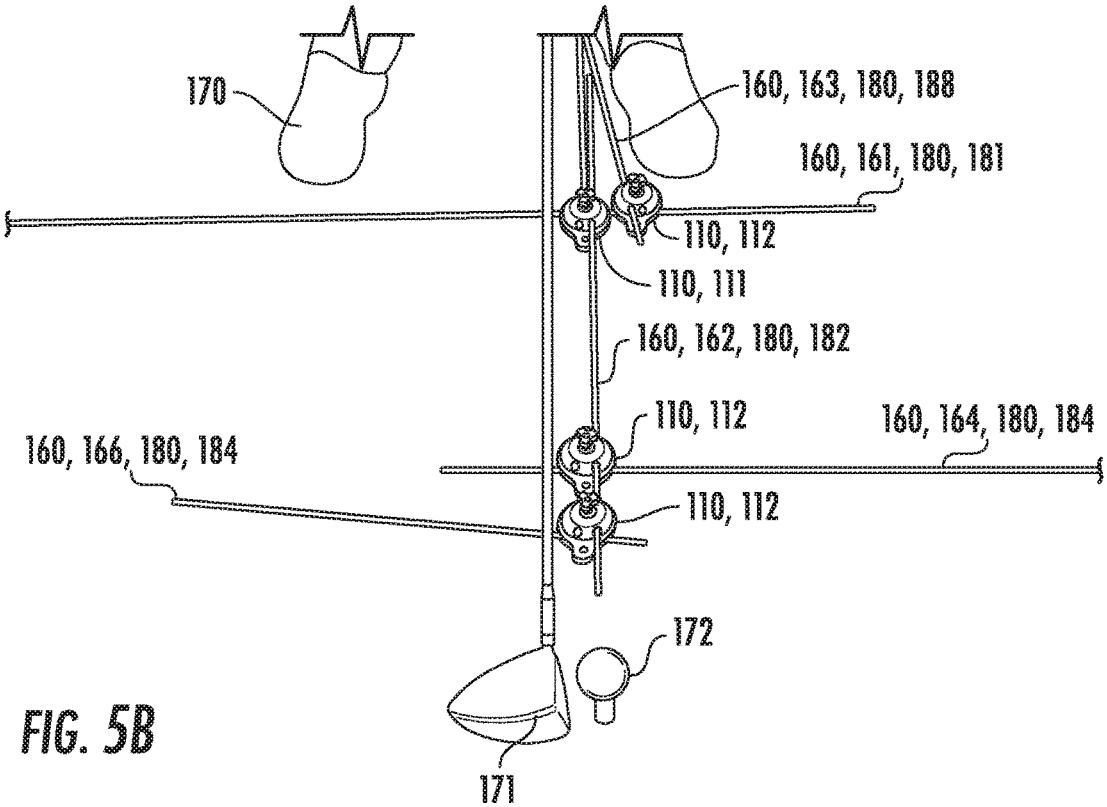
FIG. 5B is a front perspective view of an alternate embodiment of the alignment aid system, including four alignment stations and six alignment guides.

FIG. 5B is a front perspective view of an alternate embodiment of alignment aid system 100, including four alignment stations 110 and six alignment guides 160. This embodiment of alignment aid system 100 comprises four alignment stations 110, including primary alignment station 111, and three additional alignment stations 112, and six alignment guides 160. Primary alignment station 111 houses second alignment guide 162 through a base port 152, which passes through to an additional alignment station 112, connecting through a base port 152 of that additional alignment station 112. Here this first alignment guide 161 comprises a path 180 consisting of foot position 181. Here, this additional alignment station 112 connects to a first alignment guide 161 through its base port 152. Here, this second alignment station 112 houses a heel position 188 through top port 151. An alignment guide 160 also passes through one of the top ports 151 in the station top 130. This alignment guide 160, the second alignment guide 162, is set perpendicular to the first alignment guide 161. This second alignment guide 162 is set to the ball position. Additional alignment stations are attached to the alignment guides 160 as needed. Additional alignment stations can be attached to either the first or second alignment guides as required. The second, third, fourth, etc. guides can be used for setting foot position 181, hand position 189, ball position 182, club face angle 183, swing path 184, target path 185, and heel position 188.

Figure 5C:
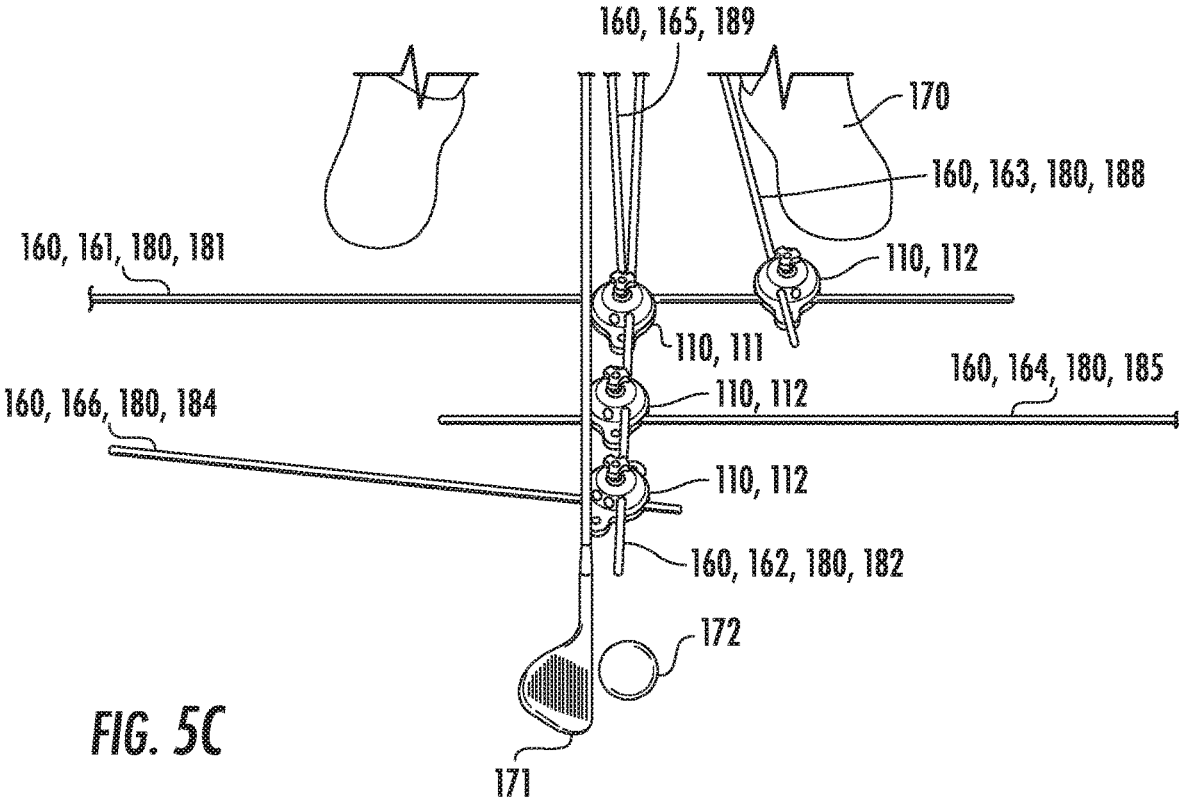
FIG. 5C is a front perspective view of the alignment aid system shown in FIG. 5B, showing an alternate arrangement of the elements.

FIG. 5C is a front perspective view of the alignment aid system shown in FIG, 5B, showing an alternate arrangement of the elements. This configuration shows a similar configuration to FIG. 5A except there is a closer proximity of the primary alignment station 111, and additional alignment station 112 positions along guide 162 when using a shorter length golf club 171. The additional alignment station 112 on guide 161 is placed further from the primary alignment station 111, to enable setting the heel position 183 with third alignment guide 163, further from the second alignment guide 162, ball position 182.

Figure 5D:
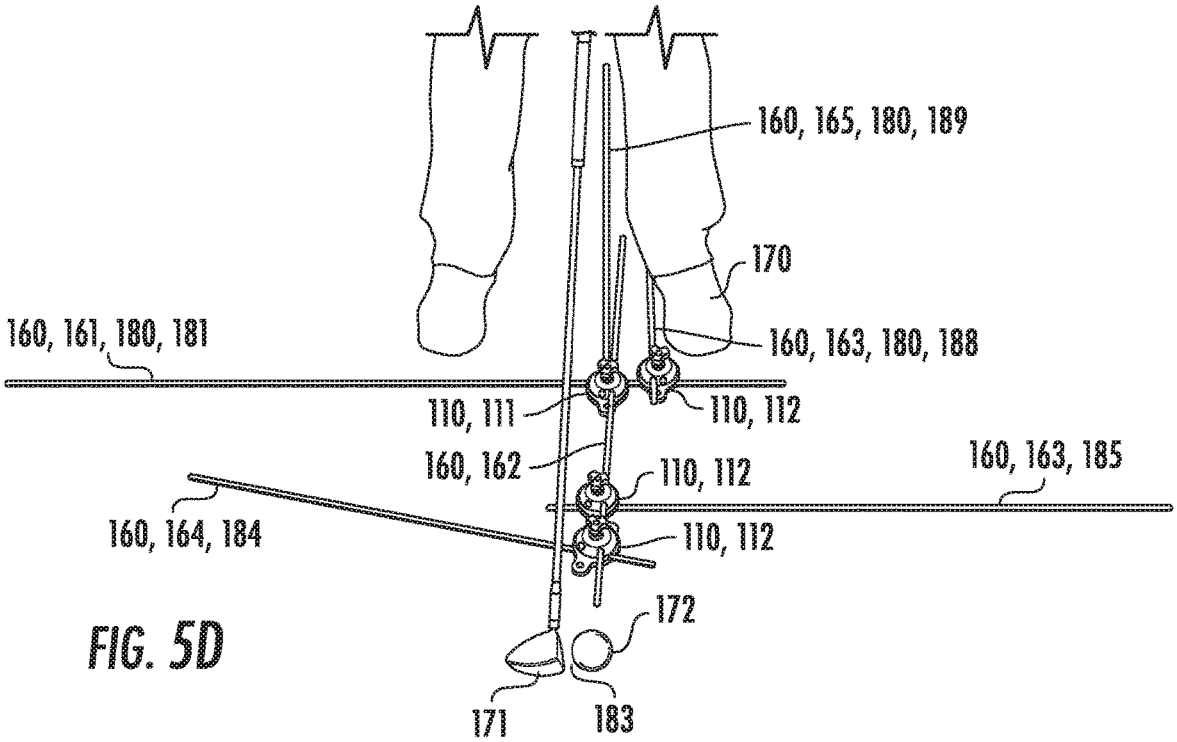
FIG. 5D is a front perspective view of the alignment aid system shown in FIGS. 5B and 5C, showing an alternate arrangement of the elements.

FIG. 5D is a front perspective view of the alignment aid system shown in FIGS. 5B and 5C, showing an alternate arrangement of alignment stations 110, including primary alignment station 111, three additional alignment stations 112, and four alignment guides 160. This view shows additional modifications can be set to all of the alignment stations 110, and all of the alignment guides 160 in order to accommodate the varied spatial relationships necessary between the ball 172, the ball position 182 and the foot position 181 in FIGS. 5B, 5C and 5D as different length golf clubs 171 are used.

Figure 5E:
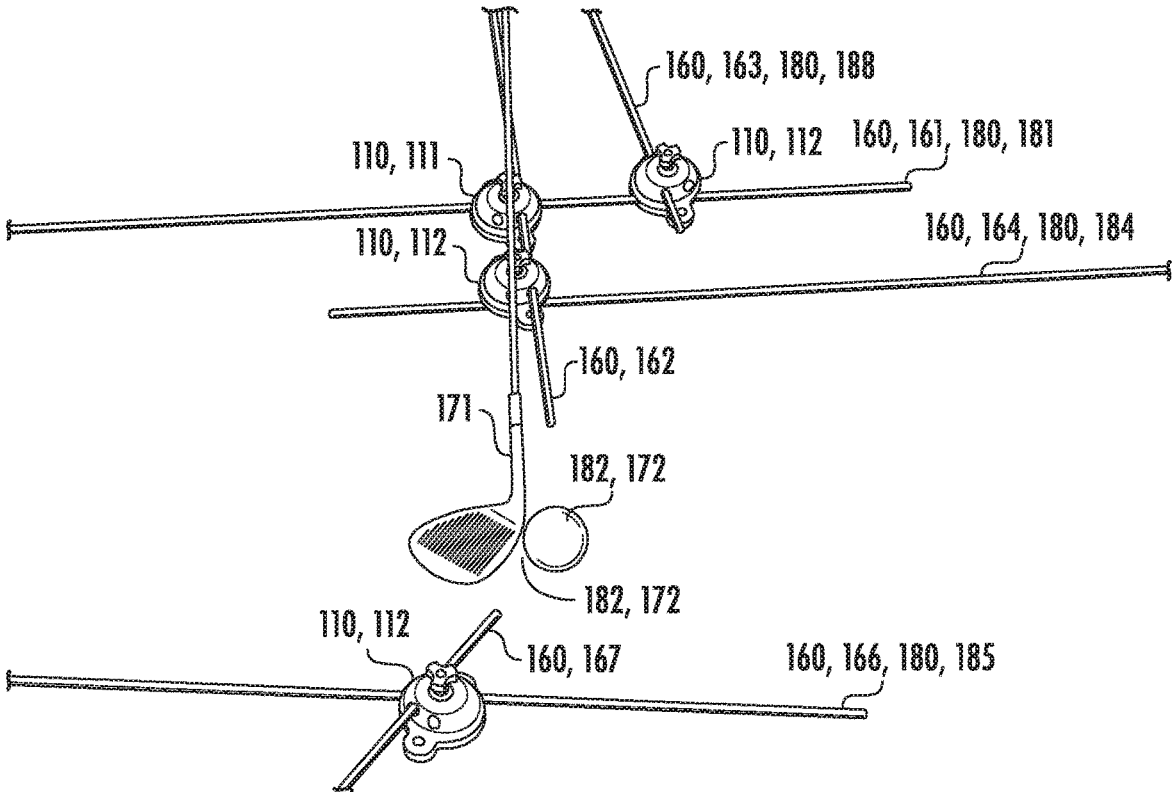
FIG. 5E is a front perspective view of the alignment aid system shown in FIGS. 5B, 5C, and 5D, showing an alternate arrangement of the elements.

FIG. 5E is a front perspective view of the alignment aid system shown in FIGS. 5B, 5C, and 5D, showing an alternate arrangement of alignment stations 110, including primary alignment station 111, three additional alignment stations 112, and four alignment guides 160. This configuration further shows that the additional alignment stations can be separated from the multiple joined configurations demonstrated in FIGS. 5B, 5C, and 5D when it is necessary to use a separate alignment station 110 in addition to the joined primary alignment station 111 and additional alignment stations 112.

Figure 5F:
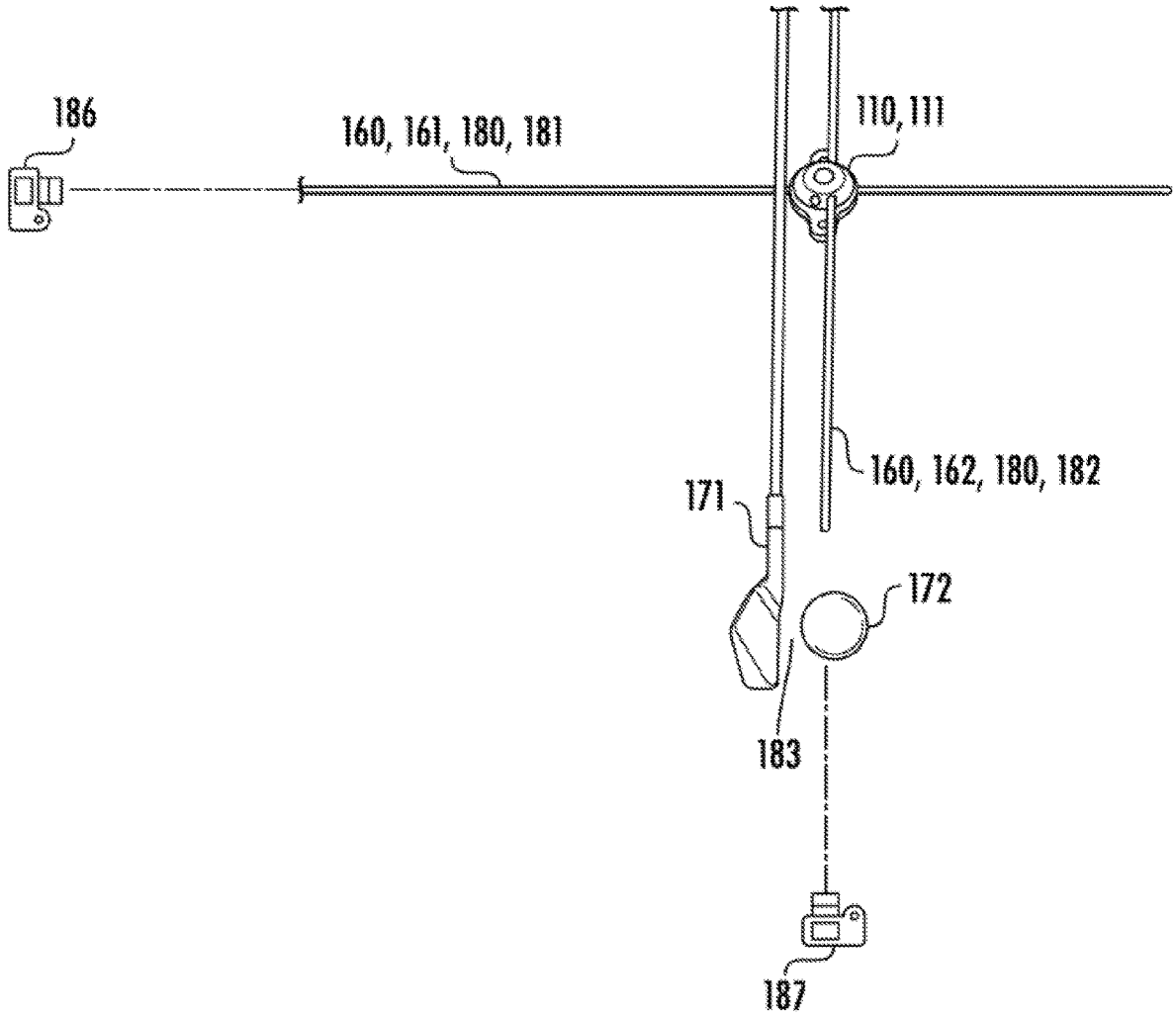
FIG. 5F is a front perspective view of the alignment aid system shown in FIG. 1A, incorporating optimally placed cameras.

FIG. 5F is a front perspective view of the alignment aid system 100 shown in FIG. 1A, incorporating optimally placed cameras 178. In one preferred embodiment, one camera 178 is placed with a view along first alignment guide 161 in line with the foot position 181, and another camera 178 is placed with a view along second alignment guide 162 in line with the ball position 182. As one with ordinary skill in the art will understand, under appropriate circumstances additional cameras 178 could be placed as to provide views along additional paths 180, including but not limited to: club face angle 183, swing path 184, target path 185, down-the line camera position 186, face-on camera position 187, heel position 188, and/or hand position 189.

As one with ordinary skill in the art will understand, under appropriate circumstances a sensor and transceiver system could be incorporated into said alignment aid system 100 to permit the automatic recognition of one or more paths 180 by a computer system. Such a system could be further improved by placing markers on the feet, hands, legs, and other body parts of user 170, as well as on club 171, ball 172, which would permit a sensor and transceiver system to collect information about the actual path of such markers. A computer system could then compare the actual paths of such markers to the desired paths 180, providing improved feedback about how to improve alignments.

What is claimed is:

1. An alignment aid system for providing adjustable guides, comprising:

a) a primary alignment station;

b) a first alignment guide;

c) a second alignment guide;

d) wherein said primary alignment station further comprises:

i. a station top, the top having a top surface and a bottom surface, ii. a station base, the base having a top surface and a bottom surface, iii. a station joiner, and iv. wherein the bottom surface of the station top rests on the top surface of the station base;

v. wherein said station top rotates parallel to said station base, while contact is maintained between the bottom surface of the station top and the top surface of the station base;

e) wherein said station top further comprises at least one guide port structured and arranged to securely house said first alignment guide passing through the full width of the station top; and f) wherein said station base further comprises at least one guide port structured and arranged to securely house said second alignment guide spanning the full width of the top surface of the station base;

g) wherein said station joiner further comprises an alignment station lock for locking said station top positionally relative to said station base; and h) wherein said station joiner further comprises an alignment guide lock for locking said first and second alignment guides in place within said guide ports.

2. The alignment aid system described in claim 1, wherein said station top rotates 360 degrees about an axis located at the centerpoint of both the station top and the station base, to permit the unrestricted angular rotation to the desired required angular position and locked to the desired position of said first alignment guide relative to said second alignment guide.

3. The alignment aid system described in claim 2, wherein said alignment guide lock is structured and arranged to permit said first and second alignment guides to be locked in place at any point along each of the alignment guides.

4. The alignment aid system described in claim 2, wherein said alignment station further comprises angular measurement indicators structured and arranged to permit a user to read an angular displacement between the alignment guides attached to said station top and said station base.

5. The alignment aid system described in claim 4, wherein said station top further comprises a second guide port housing a third alignment guide; wherein said station base further comprises a second guide port housing a fourth alignment guide; wherein said first and third alignment guides are offset and parallel; wherein said second and fourth alignment guides are offset and parallel; and wherein said second and fourth alignment guides are locked into place by said station joiner.

6. The alignment aid system described in claim 1, wherein station top further comprises a lock seat notch, wherein said joiner comprises a friction lock comprising a nut, washer, and bolt; wherein said washer rests on the top surface of said lock seat notch, wherein said bolt passes through a hole extending vertically through the centerpoint of said station base and said station top, through said washer and, into said nut, securing said station top in place relative to said alignment station.

7. The alignment aid system described in claim 6:

a) wherein said station top further comprises:

i. a lock seat notch comprising a top surface and an indentation;

ii. wherein said top surface of the lock seat notch comprises the shape of the bottom surface of the washer;

iii. wherein said indentation comprises an opening structured and arranged to expose a portion of the top of the station top's guide port and the top of the first alignment guide, and said indentation extends down into the top of the station top's guide port;

iv. wherein the top surface of the station top's guide port extends vertically above the top surface of, and into the indentation of, the lock seat notch;

v. wherein said washer rests on the top surface of said first alignment guide extending through the station top's guide port and lays slightly above the top surface of the lock seat notch;

vi. wherein said washer directly presses down on the top surface of the first alignment guide when the station joiner is tightened, locking the first alignment guide in place.

8. The alignment aid system described in claim 7, wherein said alignment aid system further comprises additional alignment stations, wherein said alignment stations are connected by an alignment guide, extending from a guide port of one alignment station into the port of another alignment station, with additional alignment guides extending from the other guide ports of said additional alignment stations, with all alignment guides being locked into place by the station joiners of each alignment station.

9. The alignment aid system described in claim 7, wherein said wherein said station base guide port further comprises:

a) a groove that extending the full width of the top surface of the station base with a depth that is slightly less than the diameter of the second alignment guide;

b) wherein, when placed inside the station base guide port, the top surface of the alignment guide is slightly above the top surface of the station base;

c) wherein the bottom surface of the station top directly presses down on the top surface of the second alignment guide when the station joiner is tightened, locking the second alignment guide in place.

10. The alignment aid system described in claim 8, wherein said alignment guides are arranged as to assist in one or more of the following purposes: placing ball position relative to foot placement; setting the distance to stand from the ball for each club for proper posture; aligning swing paths; establishing target path alignment; determining foot, hand, shoulder and knee positioning; checking clubface alignment; and to accurately position a camera for photographing and/or video recording golf swings.

11. The alignment aid system described in claim 8, wherein all of said alignment stations and alignment guides are locked into place by said station joiners, allowing said alignment aid system to be moved without affecting the relative angular orientations of said alignment stations and alignment guides.

12. The alignment aid system described in claim 1, further comprising an anchor for anchoring said alignment station to a surface.

13. The alignment aid system described in claim 1, wherein a vertical alignment guide placed into a vertical port, structured and arranged to allow a user to orient the user's hands relative to the vertical alignment guide, is attached to said alignment station.

14. The alignment aid system described in claim 1, further comprising at least one camera placed along one or more of the following paths: foot position; ball position;

club face angle; swing path; and target path.

15. The alignment aid system described in claim 1, wherein said station top comprises a single monolithic piece; wherein said station base comprises a single monolithic piece.

16. The alignment aid system described in claim 1, wherein the tightening of said station joiner simultaneously locks in place the following: said alignment guides housed within said guide ports; the length of the portion of said alignment guides that extends out from said alignment station; the angular orientation of said station top relative to said station base.

17. An alignment aid system comprising:

a) At least one alignment station;

b) At least two alignment guides;

c) Wherein said at least one alignment station further comprises:

i. At least one station base, ii. At least one station top, and iii. At least one station joiner, comprising a bolt, a washer, and a nut;

f) Wherein said alignment station comprises at least two guide ports each structured and arranged to house an alignment guide;

i) wherein said station top further comprises:

i. a lock seat notch comprising a top surface and an indentation;

ii. wherein said top surface of the lock seat notch comprises the shape of the bottom surface of a washer;

iii. wherein said indentation comprises an opening structured and arranged to expose a portion of the top of the station top's guide port and the top of the first alignment guide, and said indentation extends down into the top of the station top's guide port;

iv. wherein the top surface of the station top's guide port extends vertically above the top surface of, and into the indentation of, the lock seat notch;

v. wherein said washer rests on the top surface of said first alignment guide extending through the station top's guide port and lays slightly above the top surface of the lock seat notch;

vi. wherein said washer directly presses down on the top surface of the first alignment guide when the station joiner tightened, locking the first alignment guide in place;

j) wherein said station base guide port further comprises:

i. a groove that extending the full width of the top surface of the station base with a depth that is slightly less than the diameter of the second alignment guide;

wherein, when placed inside the station base guide port, the top surface of the alignment guide is slightly above the top surface of the station base;

iii. wherein the bottom surface of the station top directly presses down on the top surface of the second alignment guide when the station joiner is tightened, locking the second alignment guide in place.

18. The alignment aid system described in claim 17, wherein said station top rotates 360 degrees about an axis located at the centerpoint of both the station top and the station base.

19. The alignment aid system described in claim 17, wherein said alignment aid system further comprises additional alignment stations, wherein said alignment stations are connected by an alignment guide, extending from a guide port of one alignment station into the port of another alignment station, with additional alignment guides extending from the other guide ports of said additional alignment stations, with all alignment guides being locked into place by the station joiners of each alignment station.

20. The alignment aid system described in claim 17, wherein all of said alignment stations and alignment guides are locked into place by said station joiners, allowing said alignment aid system to be moved without affecting the relative angular orientations of said alignment stations and alignment guides.

* * * * *